US009565509B2

(12) United States Patent
Engdegard et al.

(10) Patent No.: US 9,565,509 B2
(45) Date of Patent: Feb. 7, 2017

(54) ENHANCED CODING AND PARAMETER REPRESENTATION OF MULTICHANNEL DOWNMIXED OBJECT CODING

(75) Inventors: Jonas Engdegard, Stockholm (SE); Lars Villemoes, Jaerfaella (SE); Heiko Purnhagen, Sundbyberg (SE); Barbara Resch, Solna (SE)

(73) Assignee: DOLBY INTERNATIONAL AB, Amsterdam Zuid-Oost (NL)

( * ) Notice: Subject to any disclaimer, the term of this patent is extended or adjusted under 35 U.S.C. 154(b) by 1778 days.

(21) Appl. No.: 12/445,701

(22) PCT Filed: Oct. 5, 2007

(86) PCT No.: PCT/EP2007/008683

§ 371 (c)(1),
(2), (4) Date: Oct. 15, 2010

(87) PCT Pub. No.: WO2008/046531

PCT Pub. Date: Apr. 24, 2008

(65) Prior Publication Data

US 2011/0022402 A1 Jan. 27, 2011

Related U.S. Application Data

(60) Provisional application No. 60/829,649, filed on Oct. 16, 2006.

(51) Int. Cl.
*G10L 19/00* (2013.01)
*H04S 7/00* (2006.01)
(Continued)

(52) U.S. Cl.
CPC ..... *H04S 7/30* (2013.01); *G10L 19/008* (2013.01); *G10L 19/20* (2013.01); *H04S 3/008* (2013.01);
(Continued)

(58) Field of Classification Search
USPC ..... 381/23, 22, 2, 3, 14–17; 704/500, 501, 704/225; 700/94
See application file for complete search history.

(56) References Cited

U.S. PATENT DOCUMENTS 5,761,634 A 6/1998 Stewart et al.
5,912,976 A 6/1999 Klayman et al.
(Continued)

FOREIGN PATENT DOCUMENTS

AU 2007312598 B2 10/2007
EP 0951021 A2 10/1999
(Continued)

OTHER PUBLICATIONS

ISO IEC JTC SC29 WG 11 N8329, Concept of object oriented spatial audio coding, Jul. 2006.*
(Continued)

*Primary Examiner* — Davetta W Goins
*Assistant Examiner* — Kuassi Ganmavo
(74) *Attorney, Agent, or Firm* — Perkins Coie LLP; Michael A. Glenn

(57) ABSTRACT

An audio object coder for generating an encoded object signal using a plurality of audio objects includes a downmix information generator for generating downmix information indicating a distribution of the plurality of audio objects into at least two downmix channels, an audio object parameter generator for generating object parameters for the audio objects, and an output interface for generating the imported audio output signal using the downmix information and the object parameters. An audio synthesizer uses the downmix information for generating output data usable for creating a plurality of output channels of the predefined audio output configuration.

15 Claims, 17 Drawing Sheets

(51) Int. Cl.

| | |
|---|---|
| *G10L 19/008* | (2013.01) |
| *H04S 3/00* | (2006.01) |
| *H04S 3/02* | (2006.01) |
| *H04S 5/00* | (2006.01) |
| *G10L 19/20* | (2013.01) |

(52) U.S. Cl.

CPC .. *H04S 3/02* (2013.01); *H04S 5/00* (2013.01); *H04S 2400/03* (2013.01); *H04S 2400/11* (2013.01); *H04S 2420/03* (2013.01)

(56) References Cited

U.S. PATENT DOCUMENTS

| | | | | |
|---|---|---|---|---|
| 7,447,629 | B2 | 11/2008 | Breebart | |
| 7,555,009 | B2 | 6/2009 | Oshima | |
| 7,761,177 | B2 | 7/2010 | Oh et al. | |
| 7,797,163 | B2 | 9/2010 | Pang et al. | |
| 7,961,890 | B2 | 6/2011 | Holzer et al. | |
| 7,965,848 | B2 | 6/2011 | Villemoes et al. | |
| 7,986,789 | B2 | 7/2011 | Pumhagen et al. | |
| 8,213,641 | B2 * | 7/2012 | Faller et al. | 381/119 |
| 8,214,221 | B2 | 7/2012 | Pang et al. | |
| 9,418,667 | B2 * | 8/2016 | Oh | G10L 19/008 |
| 2004/0057457 | A1 | 3/2004 | Ahn et al. | |
| 2004/0138873 | A1 * | 7/2004 | Heo | G11B 20/10527 704/201 |
| 2005/0022841 | A1 | 2/2005 | Wittebrood | |
| 2005/0074127 | A1 | 4/2005 | Herre et al. | |
| 2005/0141722 | A1 * | 6/2005 | Van De Kerkhof et al. | 381/23 |
| 2005/0177360 | A1 | 8/2005 | Schuijers et al. | |
| 2005/0195981 | A1 | 9/2005 | Faller et al. | |
| 2006/0009225 | A1 | 1/2006 | Herre et al. | |
| 2006/0100809 | A1 | 5/2006 | Yoneda | |
| 2006/0165237 | A1 | 7/2006 | Villemones | |
| 2006/0190247 | A1 | 8/2006 | Lindblom | |
| 2006/0235679 | A1 | 10/2006 | Sperschneider et al. | |
| 2007/0002971 | A1 * | 1/2007 | Purnhagen et al. | 375/316 |
| 2007/0019813 | A1 * | 1/2007 | Hilpert et al. | 381/22 |
| 2007/0071247 | A1 | 3/2007 | Pang et al. | |
| 2008/0008323 | A1 * | 1/2008 | Hilpert et al. | 381/1 |
| 2008/0130904 | A1 * | 6/2008 | Faller | 381/17 |
| 2008/0140426 | A1 * | 6/2008 | Kim et al. | 704/500 |
| 2008/0154583 | A1 * | 6/2008 | Goto | G10L 19/008 704/205 |
| 2008/0255857 | A1 | 10/2008 | Pang et al. | |
| 2008/0262854 | A1 * | 10/2008 | Jung et al. | 704/500 |
| 2008/0319765 | A1 | 12/2008 | Oh et al. | |
| 2009/0006106 | A1 | 1/2009 | Pang et al. | |
| 2009/0110203 | A1 | 4/2009 | Taleb | |
| 2009/0144063 | A1 | 6/2009 | Beack et al. | |
| 2009/0164222 | A1 | 6/2009 | Kim et al. | |
| 2009/0177479 | A1 * | 7/2009 | Yoon et al. | 704/500 |
| 2009/0182564 | A1 | 7/2009 | Beack et al. | |
| 2010/0153097 | A1 * | 6/2010 | Hotho et al. | 704/201 |

FOREIGN PATENT DOCUMENTS

| | | | | |
|---|---|---|---|---|
| EP | 1376538 | A1 | 1/2004 | |
| EP | 1691348 | A1 | 8/2006 | |
| EP | 1984916 | A1 | 8/2007 | |
| EP | 1853092 | | 11/2007 | |
| EP | 2100297 | A1 | 4/2008 | |
| JP | 2002511683 | | 4/2002 | |
| JP | 2002369152 | | 12/2002 | |
| JP | 20046031 | | 1/2004 | |
| JP | 2004-523163 | | 7/2004 | |
| JP | 2004193877 | | 7/2004 | |
| JP | 200593058 | | 4/2005 | |
| JP | 2005-151129 | | 6/2005 | |
| JP | 2006101248 | | 4/2006 | |
| JP | 2008517337 | | 5/2008 | |
| JP | 2010-505328 | | 2/2010 | |
| KR | WO 2007058510 | A1 * | 5/2007 | G10L 19/008 |
| NL | WO 2005098824 | A1 * | 10/2005 | G10L 19/008 |
| RU | 2129737 | | 4/1999 | |
| RU | 2005104123 | A | 5/2008 | |
| RU | 2363116 | | 7/2009 | |
| RU | 2005103637 | A | 7/2009 | |
| TW | 200611241 | A | 8/1994 | |
| TW | 20061226041 | | 4/2006 | |
| WO | WO 99/52326 | | 10/1999 | |
| WO | WO2004086817 | | 10/2004 | |
| WO | WO2005/098826 | A1 | 10/2005 | |
| WO | WO 2006/048203 | | 5/2006 | |
| WO | WO2006/060279 | | 6/2006 | |
| WO | WO 2006060279 | A * | 6/2006 | |
| WO | WO 2006/084916 | A2 | 8/2006 | |

OTHER PUBLICATIONS

ISO IEC JTC SC29 WG 11 N8329, Concepts of object oriented spatial audio coding, Jul. 2006.*

ISO-IEC, Concepts of Object-Oriented Spatial Audio Coding, Jul. 2006.*

Jang, Inseon et al.; "Low-bitrate multichannel audio coding"; 2005; Journal of Broadcast Engineering; The Korean Society of Broadcast Engineers, vol. 10, pp. 328-339.

Office Action mailed Nov. 9, 2010 in related Korean Patent Application No. 10-2009-7007754, 5 pages.

"WD on ISO/IEC 23003:2:200x, SAOC text and reference software", ISO/IEC JTC 1/SC 29/WG11 N9517, Shenzhen, China, Oct. 2007, 80 pages.

Engdegard, et al., "CT/Fraunhofer IIS/Philips Submission to the SAOC CfP", ISO/IEC JTC1/SC29/WG11, MPEG2007/M14696, Lausanne, CH, Jul. 2007, 14 pages.

Faller, C. et al; "Binaural Cue Coding Applied to Audio Compression with Flexible Rendering"; Oct. 2002; AES 113th Convention, LA CA Preprint 5686.

Faller, C.; "Parametric Joint-Coding of Audio Sources"; May 20-23, 2006; Convention Paper 6752 presented at the 120th AES Convention, Paris, France.

Faller, C. et al.; "Efficient representation of spatial audio using perceptual parametrization"; Oct. 2001; IEEE WASPAA, Mohonk, NY.

Baumgarte, F. et al.; "Estimation of auditory spatial cues for binaural cue coding"; May 2002; ICASSP, Orlando, Florida.

Faller, C. et al.; "Binaural cue coding: a novel and efficient representation of spatial audio"; May 2002; ICASSP; Orlando, Florida.

Faller, C. et al.; "Binaural cue coding applied to stereo and multichannel audio compression"; May 2002; AES 112th Convention, Munich Germany, Preprint 5574.

Faller, C. et al.; "Binaural Cue Coding—Part II: Schemes and applications"; Nov. 2003, IEEE Trans. on Speech and Audio Proc., vol. 11, No. 6.

Breebaart, J. et al.; "High-Quality Parametric Spatial Audio Coding at Low Bitrates"; May 2004; AES 16th Convention; Berlin, Germany, Preprint 6072.

Schuijers, E. et al.; "Low Complexity Parametric Stereo Coding"; May 2004; AES 116th Convention, Berlin, Germany, Preprint 6073.

ISO/IEC JTC1/SC29/WG11 (MPEG), Document N8324, "Text of ISO/IEC FDIS 23003-1:2006, MPEG Surround"; Jul. 2006; Klagenfurt, Austria.

Pulkki, V.; "Spatial Sound Generation and Perception by Amplitude Panning Techniques"; 2001; Helsinki University of Technology, Helsinki, Finland.

Recommendation ITU-R BS.775-1, "Multichannel Stereophonic Sound System With and Without Accompanying Picture"; 1992-1994.

Villemoes, L. et al.; "MPEG Surround: The Forthcoming ISO Standard for Spatial Audio Coding"; Jun. 30-Jul. 2, 2006; 28th International AES Conference, The Future of Audio Technology Surround and Beyond, Pitea, SE.

Breebaart, J. et al.; "Multi-Channel goes Mobile: MPEG Surround Binaural Rendering"; Sep. 2-4, 2006; 29th International AES Conference, Audio for Mobile and Handheld Devices, Seoul.

(56) References Cited

OTHER PUBLICATIONS

Faller, C.; "Parametric Joint-Coding of Audio Sources"; May 20-23, 2006; AES 120th Convention, Paris France, Convention Paper 6752.
Herre, et al.; "The Reference Model Architecture for MPEG Spatial Audio Coding"; May 28, 2005; Audio Engineering Society Convention paper, New York, NY pp. 1-13.
Breebaart, et al.; "MPEG spatial audio coding/MPEG surround: Overview and current status"; Oct. 7, 2005; Audio Engineering Society Convention Paper, New York, NY, pp. 1-15 XP002364486 ,pp. 1-6.
International Organization for Standardization "Concepts of Object-Oriented Spatial Audio Coding"; Jul. 21, 2006; Video Standards and Drafts; XP030014821.
Herre, et al.; "Thoughts on an SAOC Architecture"; Oct. 18, 2006; Video Standards and Drafts, No. M13935, XP030042603.
ISO/IEC 23003-1:2006/FDIS, "Information technology—MPEG audio technologies—Part 1: MPEG Surround"; Jul. 21, 2006, XP030014816, pp. 79-81 and pp. 253-257.
Concepts of Object-Oriented Spatial Audio Coding, ISO/IEC JTC I/SC 29/WG 11 N8329, Jul. 21, 2006, 8 pages.

* cited by examiner

| MODE NUMBER | DOWNMIX INFORM. | DOWNMIX CHANNELS | AUDIO OBJECT PARAMETERS | OUTPUT CONFIGURATION | INTENDED POSITIONING | OUTPUT DATA USABLE FOR RENDERING | |
|---|---|---|---|---|---|---|---|
| 1 | X | X | X | | | RECONSTRUCTED SOURCES | 111 |
| 2 | X | | X | X | X | SPATIAL MIXER PARAMETERS | 112 |
| 3 | X | | X | X | X | SPATIAL MIXER PARAMETERS AND CONVERSION MATRIX | 113 |
| 4 | X | X | X | X | X | SPATIAL MIXER PAREMETERS AND CONVERTED DOWNMIX | 114 |
| 5 | X | X | X | X | X | STEREO OUTPUT | 115 |
| 6 | X | X | X | X | X | MULTICHANNEL OUTPUT (M>2) e.g. 5.1, ... | 116 |

FIG 11

ENHANCED CODING AND PARAMETER REPRESENTATION OF MULTICHANNEL DOWNMIXED OBJECT CODING

CROSS-REFERENCE TO RELATED APPLICATIONS

This application is a U.S. national entry of PCT Patent Application Serial No. PCT/EP2007/008683 filed 5 Oct. 2007, and claims priority to U.S. Patent Application No. 60/829,649 filed 16 Oct. 2006, each of which is incorporated herein by reference.

BACKGROUND OF THE INVENTION

The present invention relates to decoding of multiple objects from an encoded multi-object signal based on an available multichannel downmix and additional control data.

Recent development in audio facilitates the recreation of a multi-channel representation of an audio signal based on a stereo (or mono) signal and corresponding control data. These parametric surround coding methods usually comprise a parameterisation. A parametric multi-channel audio decoder, (e.g. the MPEG Surround decoder defined in ISO/IEC 23003-1[1], [2]), reconstructs M channels based on K transmitted channels, where M>K, by use of the additional control data. The control data consists of a parameterisation of the multi-channel signal based on IID (Inter channel Intensity Difference) and ICC (Inter Channel Coherence). These parameters are normally extracted in the encoding stage and describe power ratios and correlation between channel pairs used in the up-mix process. Using such a coding scheme allows for coding at a significant lower data rate than transmitting the all M channels, making the coding very efficient while at the same time ensuring compatibility with both K channel devices and M channel devices.

A much related coding system is the corresponding audio object coder [3], [4] where several audio objects are downmixed at the encoder and later on upmixed guided by control data. The process of upmixing can be also seen as a separation of the objects that are mixed in the downmix. The resulting upmixed signal can be rendered into one or more playback channels. More precisely, [3,4] presents a method to synthesize audio channels from a downmix (referred to as sum signal), statistical information about the source objects, and data that describes the desired output format. In case several downmix signals are used, these downmix signals consist of different subsets of the objects, and the upmixing is performed for each downmix channel individually.

In the new method we introduce a method were the upmix is done jointly for all the downmix channels. Object coding methods have prior to the present invention not presented a solution for jointly decoding a downmix with more than one channel.

REFERENCES

[1] L. Villemoes, J. Herre, J. Breebaart, G. Hotho, S. Disch, H. Purnhagen, and K. Kjörling, "MPEG Surround: The Forthcoming ISO Standard for Spatial Audio Coding," in 28th International AES Conference, The Future of Audio Technology Surround and Beyond, Piteå, Sweden, Jun. 30-Jul. 2, 2006.

[2] J. Breebaart, J. Herre, L. Villemoes, C. Jin, K. Kjörling, J. Plogsties, and J. Koppens, "Multi-Channels goes Mobile: MPEG Surround Binaural Rendering," in 29th International AES Conference, Audio for Mobile and Handheld Devices, Seoul, Sep. 2-4, 2006.

[3] C. Faller, "Parametric Joint-Coding of Audio Sources," Convention Paper 6752 presented at the 120th AES Convention, Paris, France, May 20-23, 2006.

[4] C. Faller, "Parametric Joint-Coding of Audio Sources," Patent application PCT/EP2006/050904, 2006.

SUMMARY OF THE INVENTION

A first aspect of the invention relates to an audio object coder for generating an encoded audio object signal using a plurality of audio objects, comprising: a downmix information generator for generating downmix information indicating a distribution of the plurality of audio objects into at least two down-mix channels; an object parameter generator for generating object parameters for the audio objects; and an output interface for generating the encoded audio object signal using the downmix information and the object parameters.

A second aspect of the invention relates to an audio object coding method for generating an encoded audio object signal using a plurality of audio objects, comprising: generating downmix information indicating a distribution of the plurality of audio objects into at least two downmix channels; generating object parameters for the audio objects; and generating the encoded audio object signal using the downmix information and the object parameters.

A third aspect of the invention relates to an audio synthesizer for generating output data using an encoded audio object signal, comprising: an output data synthesizer for generating the output data usable for creating a plurality of output channels of a predefined audio output configuration representing the plurality of audio objects, the output data synthesizer being operative to use downmix information indicating a distribution of the plurality of audio objects into at least two downmix channels, and audio object parameters for the audio objects.

A fourth aspect of the invention relates to an audio synthesizing method for generating output data using an encoded audio object signal, comprising: generating the output data usable for creating a plurality of output channels of a predefined audio output configuration representing the plurality of audio objects, the output data synthesizer being operative to use downmix information indicating a distribution of the plurality of audio objects into at least two downmix channels, and audio object parameters for the audio objects.

A fifth aspect of the invention relates to an encoded audio object signal including a downmix information indicating a distribution of a plurality of audio objects into at least two downmix channels and object parameters, the object parameters being such that the reconstruction of the audio objects is possible using the object parameters and the at least two downmix channels. A sixth aspect of the invention relates to a computer program for performing, when running on a computer, the audio object coding method or the audio object decoding method.

BRIEF DESCRIPTION OF THE DRAWINGS

Embodiments of the present invention will be detailed subsequently referring to the appended drawings, in which:

FIG. 11 illustrates a table for showing different advantageous decoder/synthesizer modes;

DETAILED DESCRIPTION OF THE INVENTION

Figure 1A:
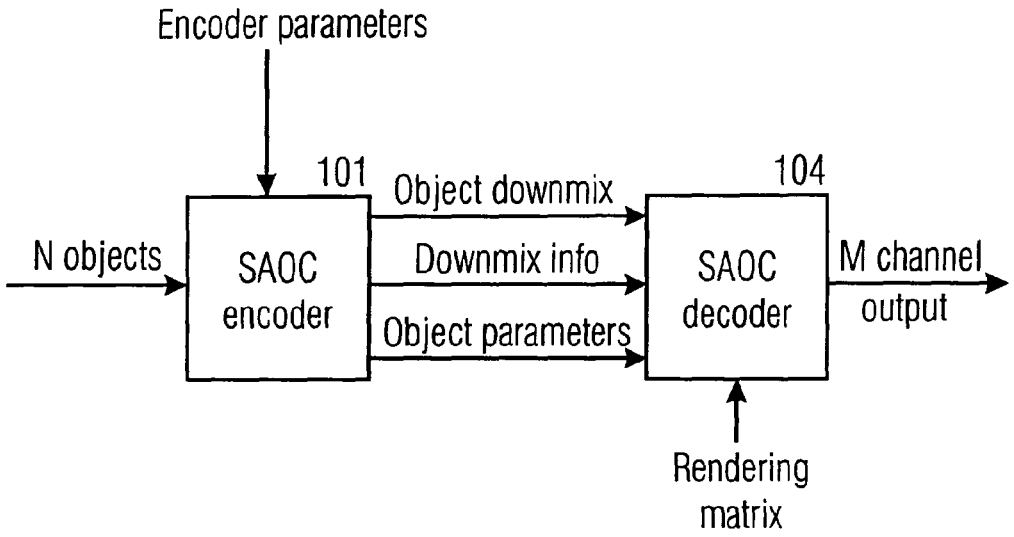
FIG. 1*a* illustrates the operation of spatial audio object coding comprising encoding and decoding.

The below-described embodiments are merely illustrative for the principles of the present invention for ENHANCED CODING AND PARAMETER REPRESENTATION OF MULTI-CHANNEL DOWNMIXED OBJECT CODING. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Preferred embodiments provide a coding scheme that combines the functionality of an object coding scheme with the rendering capabilities of a multi-channel decoder. The transmitted control data is related to the individual objects and allows therefore a manipulation in the reproduction in terms of spatial position and level. Thus the control data is directly related to the so called scene description, giving information on the positioning of the objects. The scene description can be either controlled on the decoder side interactively by the listener or also on the encoder side by the producer. A transcoder stage as taught by the invention is used to convert the object related control data and downmix signal into control data and a downmix signal that is related to the reproduction system, as e.g. the MPEG Surround decoder.

In the presented coding scheme the objects can be arbitrarily distributed in the available downmix channels at the encoder. The transcoder makes explicit use of the multichannel downmix information, providing a transcoded downmix signal and object related control data. By this means the upmixing at the decoder is not done for all channels individually as proposed in [3], but all downmix channels are treated at the same time in one single upmixing process. In the new scheme the multichannel downmix information has to be part of the control data and is encoded by the object encoder.

The distribution of the objects into the downmix channels can be done in an automatic way or it can be a design choice on the encoder side. In the latter case one can design the downmix to be suitable for playback by an existing multichannel reproduction scheme (e.g., Stereo reproduction system), featuring a reproduction and omitting the transcoding and multi-channel decoding stage. This is a further advantage over conventional coding schemes, consisting of a single downmix channel, or multiple downmix channels containing subsets of the source objects.

While conventional object coding schemes solely describe the decoding process using a single down-mix channel, the present invention does not suffer from this limitation as it supplies a method to jointly decode downmixes containing more than one channel downmix. The obtainable quality in the separation of objects increases by an increased number of downmix channels. Thus the invention successfully bridges the gap between an object coding scheme with a single mono downmix channel and multichannel coding scheme where each object is transmitted in a separate channel. The proposed scheme thus allows flexible scaling of quality for the separation of objects according to requirements of the application and the properties of the transmission system (such as the channel capacity).

Furthermore, using more than one downmix channel is advantageous since it allows to additionally consider for correlation between the individual objects instead of restricting the description to intensity differences as in conventional object coding schemes. Prior art schemes rely on the assumption that all objects are independent and mutually uncorrelated (zero cross-correlation), while in reality objects are not unlikely to be correlated, as e.g. the left and right channel of a stereo signal. Incorporating correlation into the description (control data) as taught by the invention makes it more complete and thus facilitates additionally the capability to separate the objects.

Preferred embodiments comprise at least one of the following features:

A system for transmitting and creating a plurality of individual audio objects using a multi-channel downmix and additional control data describing the objects comprising: a spatial audio object encoder for encoding a plurality of audio objects into a multichannel downmix, information about the multichannel downmix, and object parameters; or a spatial audio object decoder for decoding a multichannel downmix, information about the multichannel downmix, object parameters, and an object rendering matrix into a second multichannel audio signal suitable for audio reproduction.

FIG. 1*a* illustrates the operation of spatial audio object coding (SAOC), comprising an SAOC encoder 101 and an SAOC decoder 104. The spatial audio object encoder 101 encodes N objects into an object downmix consisting of K>1 audio channels, according to encoder parameters. Information about the applied downmix weight matrix D is output by the SAOC encoder together with optional data concerning the power and correlation of the downmix. The matrix D is often, but not necessarily always, constant over time and frequency, and therefore represents a relatively low amount of information. Finally, the SAOC encoder extracts object parameters for each object as a function of both time and frequency at a resolution defined by perceptual considerations. The spatial audio object decoder 104 takes the object downmix channels, the downmix info, and the object parameters (as generated by the encoder) as input and generates an output with M audio channels for presentation to the user. The rendering of N objects into M audio channels makes use of a rendering matrix provided as user input to the SAOC decoder.

Figure 1B:
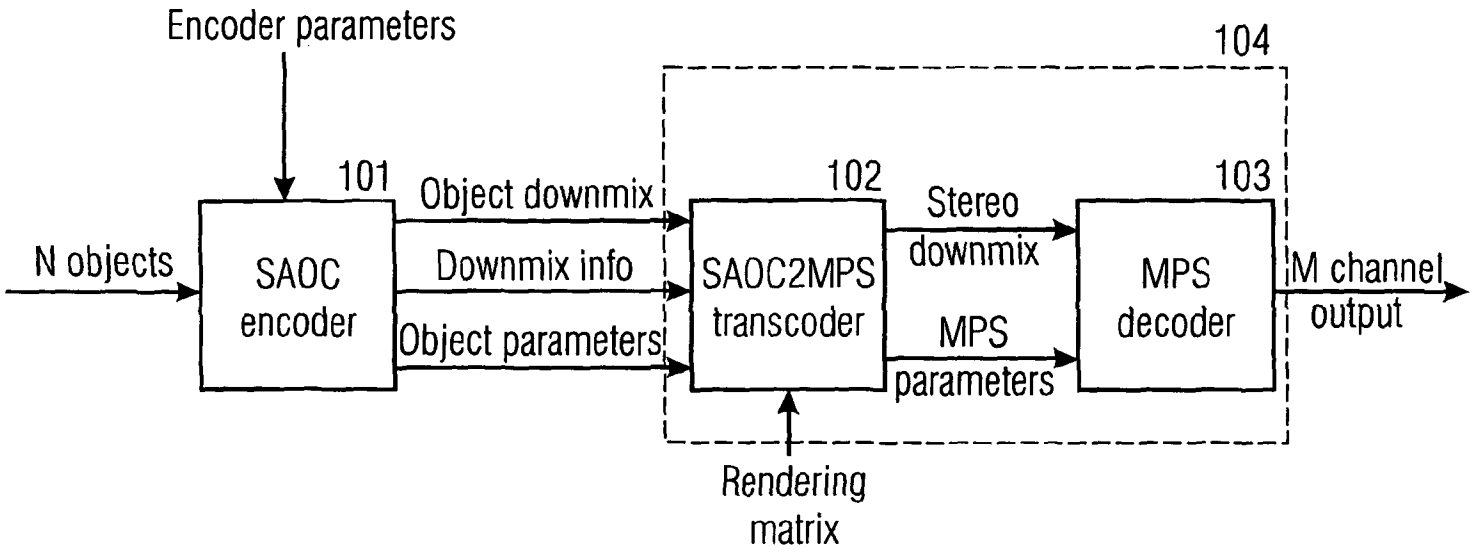
FIG. 1*b* illustrates the operation of spatial audio object coding reusing an MPEG Surround decoder.

FIG. 1*b* illustrates the operation of spatial audio object coding reusing an MPEG Surround decoder. An SAOC decoder 104 taught by the current invention can be realized as an SAOC to MPEG Surround transcoder 102 and an stereo downmix based MPEG Surround decoder 103. A user controlled rendering matrix A of size M×N defines the target rendering of the N objects to M audio channels. This matrix can depend on both time and frequency and it is the final output of a more user friendly interface for audio object manipulation (which can also make use of an externally provided scene description). In the case of a 5.1 speaker setup the number of output audio channels is M=6. The task of the SAOC decoder is to perceptually recreate the target rendering of the original audio objects. The SAOC to MPEG Surround transcoder 102 takes as input the rendering matrix A, the object downmix, the downmix side information including the downmix weight matrix D, and the object side information, and generates a stereo downmix and MPEG Surround side information. When the transcoder is built according to the current invention, a subsequent MPEG Surround decoder 103 fed with this data will produce an M channel audio output with the desired properties.

An SAOC decoder taught by the current invention consists of an SAOC to MPEG Surround transcoder 102 and an stereo downmix based MPEG Surround decoder 103. A user controlled rendering matrix A of size M×N defines the target rendering of the N objects to M audio channels. This matrix can depend on both time and frequency and it is the final output of a more user friendly interface for audio object manipulation. In the case of a 5.1 speaker setup the number of output audio channels is M=6. The task of the SAOC decoder is to perceptually recreate the target rendering of the original audio objects. The SAOC to MPEG Surround transcoder 102 takes as input the rendering matrix A, the object downmix, the downmix side information including the downmix weight matrix D, and the object side information, and generates a stereo downmix and MPEG Surround side information. When the transcoder is built according to the current invention, a subsequent MPEG Surround decoder 103 fed with this data will produce an M channel audio output with the desired properties.

Figure 2:
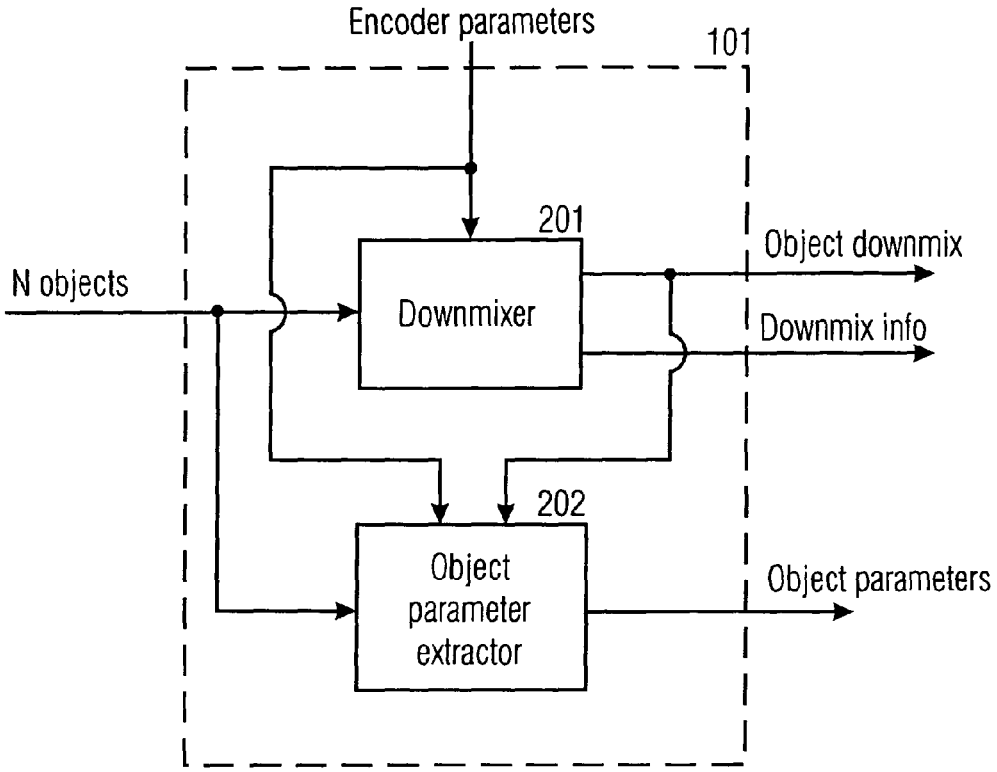
FIG. 2 illustrates the operation of a spatial audio object encoder.

FIG. 2 illustrates the operation of a spatial audio object (SAOC) encoder 101 taught by current invention. The N audio objects are fed both into a downmixer 201 and an audio object parameter extractor 202. The downmixer 201 mixes the objects into an object downmix consisting of K>1 audio channels, according to the encoder parameters and also outputs downmix information. This information includes a description of the applied downmix weight matrix D and, optionally, if the subsequent audio object parameter extractor operates in prediction mode, parameters describing the power and correlation of the object downmix. As it will be discussed in a subsequent paragraph, the role of such additional parameters is to give access to the energy and correlation of subsets of rendered audio channels in the case where the object parameters are expressed only relative to the downmix, the principal example being the back/front cues for a 5.1 speaker setup. The audio object parameter extractor 202 extracts object parameters according to the encoder parameters. The encoder control determines on a time and frequency varying basis which one of two encoder modes is applied, the energy based or the prediction based mode. In the energy based mode, the encoder parameters further contains information on a grouping of the N audio objects into P stereo objects and N-2P mono objects. Each mode will be further described by FIGS. 3 and 4.

Figure 3:
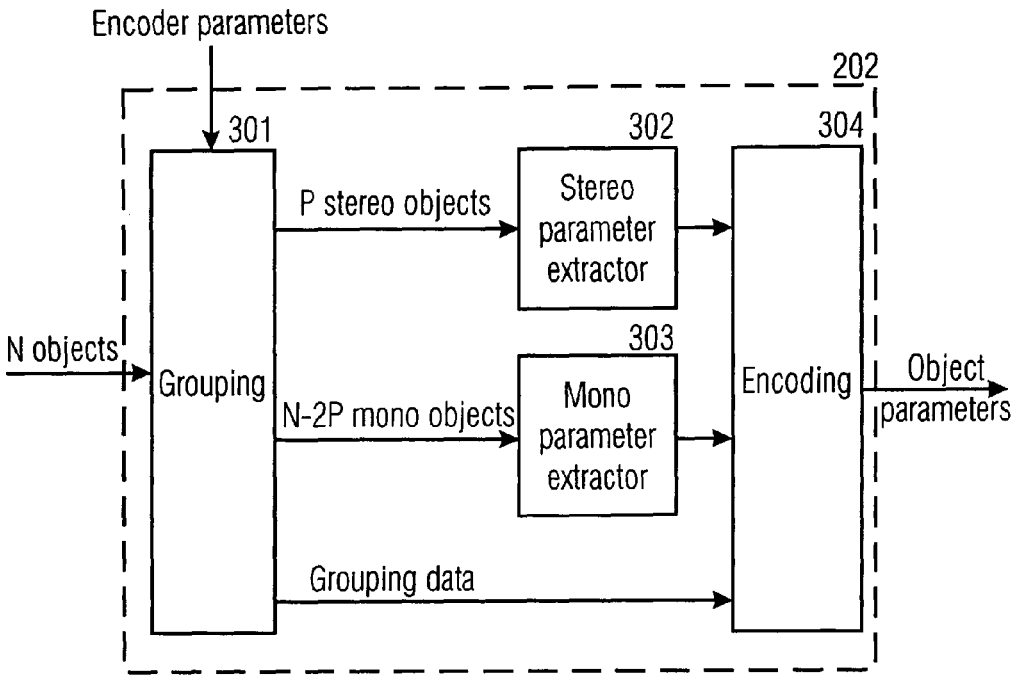
FIG. 3 illustrates an audio object parameter extractor operating in energy based mode.

FIG. 3 illustrates an audio object parameter extractor 202 operating in energy based mode. A grouping 301 into P stereo objects and N-2P mono objects is performed according to grouping information contained in the encoder parameters. For each considered time frequency interval the following operations are then performed. Two object powers and one normalized correlation are extracted for each of the P stereo objects by the stereo parameter extractor 302. One power parameter is extracted for each of the N-2P mono objects by the mono parameter extractor 303. The total set of N power parameters and P normalized correlation parameters is then encoded in 304 together with the grouping data to form the object parameters. The encoding can contain a normalization step with respect to the largest object power or with respect to the sum of extracted object powers.

Figure 4:
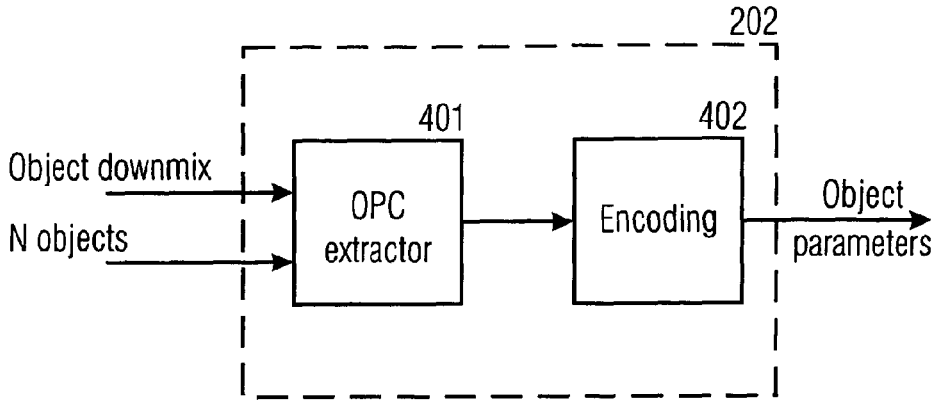
FIG. 4 illustrates an audio object parameter extractor operating in prediction based mode.

FIG. 4 illustrates an audio object parameter extractor 202 operating in prediction based mode. For each considered time frequency interval the following operations are performed. For each of the N objects, a linear combination of the K object downmix channels is derived which matches the given object in a least squares sense. The K weights of this linear combination are called Object Prediction Coefficients (OPC) and they are computed by the OPC extractor 401. The total set of N·K OPC's are encoded in 402 to form the object parameters. The encoding can incorporate a reduction of total number of OPC's based on linear interdependencies. As taught by the present invention, this total number can be reduced to max $\{K\cdot(N-K), 0\}$ if the downmix weight matrix D has full rank.

Figure 5:
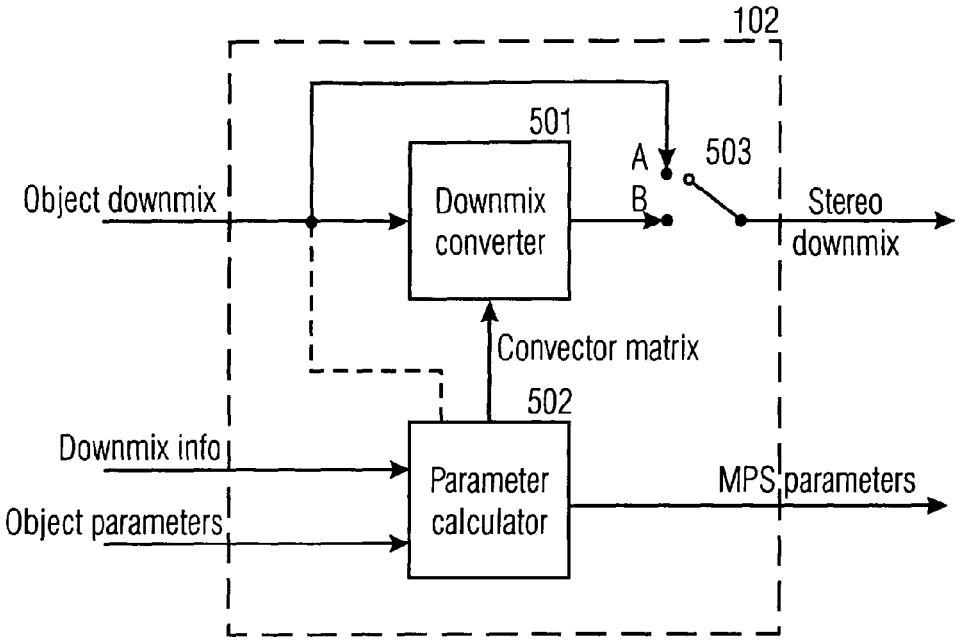
FIG. 5 illustrates the structure of an SAOC to MPEG Surround transcoder.

FIG. 5 illustrates the structure of an SAOC to MPEG Surround transcoder 102 as taught by the current invention. For each time frequency interval, the downmix side information and the object parameters are combined with the rendering matrix by the parameter calculator 502 to form MPEG Surround parameters of type CLD, CPC, and ICC, and a downmix converter matrix G of size 2×K. The downmix converter 501 converts the object downmix into a stereo downmix by applying a matrix operation according to the G matrices. In a simplified mode of the transcoder for K=2 this matrix is the identity matrix and the object downmix is passed unaltered through as stereo downmix. This mode is illustrated in the drawing with the selector switch 503 in position A, whereas the normal operation mode has the switch in position B. An additional advantage of the transcoder is its usability as a stand alone application where the MPEG Surround parameters are ignored and the output of the downmix converter is used directly as a stereo rendering.

Figure 6:
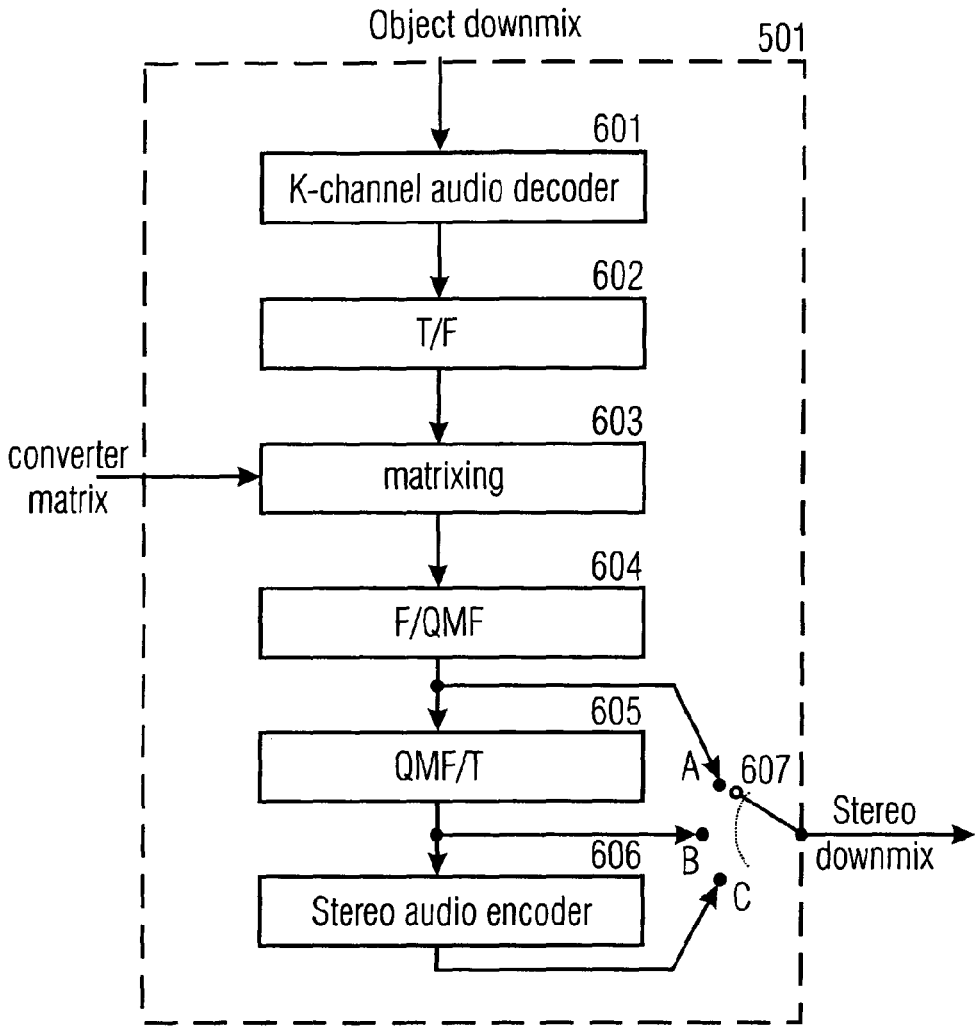
FIG. 6 illustrates different operation modes of a downmix converter.

FIG. 6 illustrates different operation modes of a downmix converter 501 as taught by the present invention. Given the transmitted object downmix in the format of a bitstream output from a K channel audio encoder, this bitstream is first decoded by the audio decoder 601 into K time domain audio signals. These signals are then all transformed to the frequency domain by an MPEG Surround hybrid QMF filter bank in the T/F unit 602. The time and frequency varying matrix operation defined by the converter matrix data is performed on the resulting hybrid QMF domain signals by the matrixing unit 603 which outputs a stereo signal in the hybrid QMF domain. The hybrid synthesis unit 604 converts the stereo hybrid QMF domain signal into a stereo QMF domain signal. The hybrid QMF domain is defined in order to obtain better frequency resolution towards lower frequencies by means of a subsequent filtering of the QMF subbands. When, this subsequent filtering is defined by banks of Nyquist filters, the conversion from the hybrid to the standard QMF domain consists of simply summing groups of hybrid subband signals, see [E. Schuijers, J. Breebart, and H. Purnhagen "Low complexity parametric stereo coding" Proc 116$^{th}$ AES convention Berlin, Germany 2004, Preprint 6073]. This signal constitutes the first possible output format of the downmix converter as defined by the selector switch 607 in position A. Such a QMF domain signal can be fed directly into the corresponding QMF domain interface of an MPEG Surround decoder, and this is the most advantageous operation mode in terms of delay, complexity and quality. The next possibility is obtained by performing a QMF filter bank synthesis 605 in order to obtain a stereo time domain signal. With the selector switch 607 in position B the converter outputs a digital audio stereo signal that also can be fed into the time domain interface of a subsequent MPEG Surround decoder, or rendered directly in a stereo playback device. The third possibility with the selector switch 607 in position C is obtained by encoding the time domain stereo signal with a stereo audio encoder 606. The output format of the downmix converter is then a stereo audio bitstream which is compatible with a core decoder contained in the MPEG decoder. This third mode of operation is suitable for the case where the SAOC to MPEG Surround transcoder is separated by the MPEG decoder by a connection that imposes restrictions on bitrate, or in the case where the user desires to store a particular object rendering for future playback.

Figure 7:
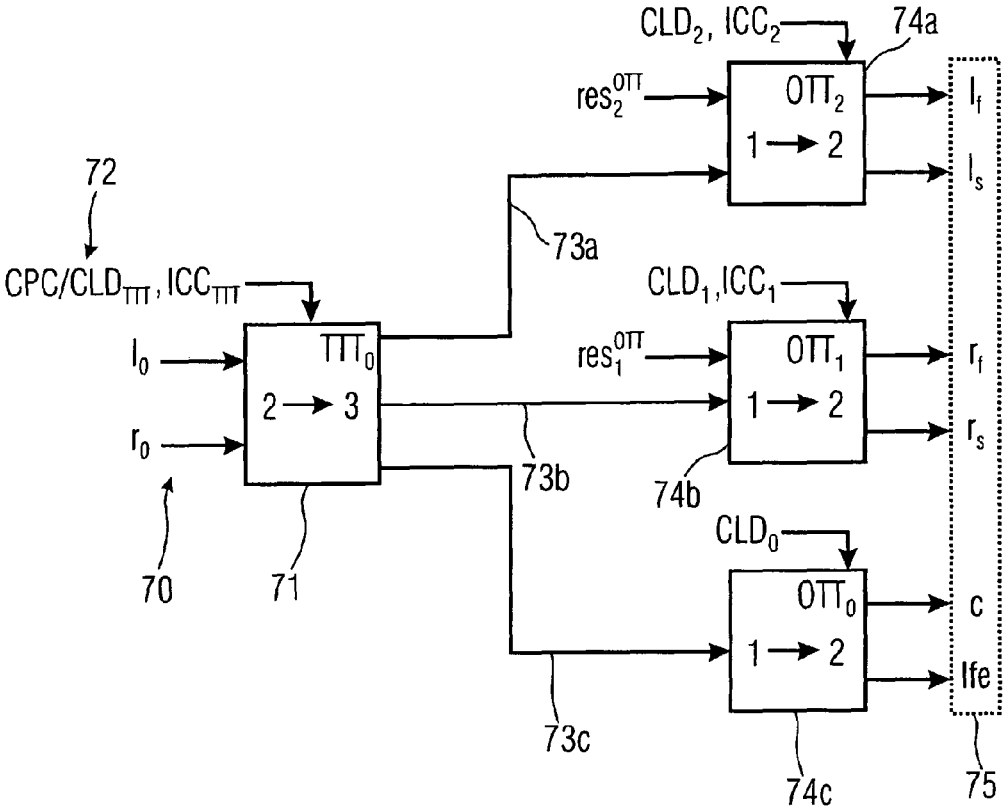
FIG. 7 illustrates the structure of an MPEG Surround decoder for a stereo downmix.

FIG. 7 illustrates the structure of an MPEG Surround decoder for a stereo downmix. The stereo down-mix is converted to three intermediate channels by the Two-To-Three (TTT) box. These intermediate channels are further split into two by the three One-To-Two (OTT) boxes to yield the six channels of a 5.1 channel configuration.

Figure 8:
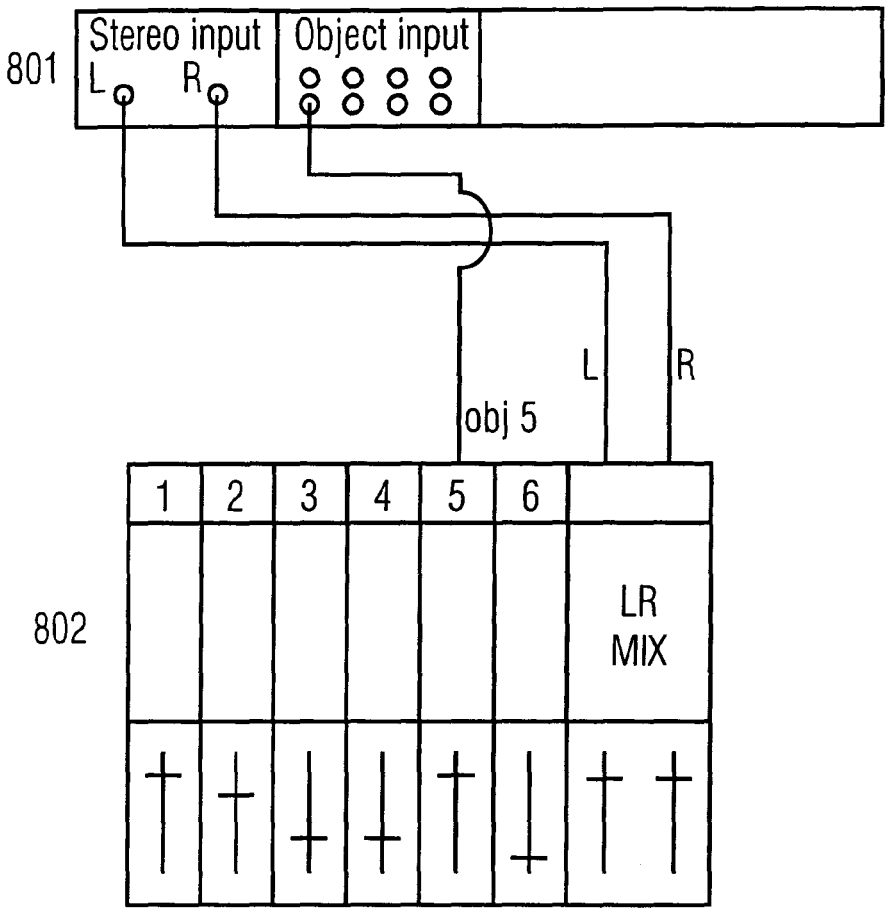
FIG. 8 illustrates a practical use case including an SAOC encoder.

FIG. 8 illustrates a practical use case including an SAOC encoder. An audio mixer 802 outputs a stereo signal (L and R) which typically is composed by combining mixer input signals (here input channels 1-6) and optionally additional inputs from effect returns such as reverb etc. The mixer also outputs an individual channel (here channel 5) from the mixer. This could be done e.g. by means of commonly used mixer functionalities such as "direct outputs" or "auxiliary send" in order to output an individual channel post any insert processes (such as dynamic processing and EQ). The stereo signal (L and R) and the individual channel output (obj5) are input to the SAOC encoder 801, which is nothing but a special case of the SAOC encoder 101 in FIG. 1. However, it clearly illustrates a typical application where the audio object obj5 (containing e.g. speech) should be subject to user controlled level modifications at the decoder side while still being part of the stereo mix (L and R). From the concept it is also obvious that two or more audio objects could be connected to the "object input" panel in 801, and moreover the stereo mix could be extended by an multichannel mix such as a 5.1-mix.

In the text which follows, the mathematical description of the present invention will be outlined. For discrete complex signals x, y, the complex inner product and squared norm (energy) is defined by $$\left\{\begin{aligned} \langle x, y\rangle &= \sum_k x(k)\bar{y}(k), \\ \|x\|^2 &= \langle x, x\rangle = \sum_k |x(k)|^2, \end{aligned}\right\} \tag{1}$$

where $\bar{y}(k)$ denotes the complex conjugate signal of y(k). All signals considered here are subband samples from a modulated filter bank or windowed FFT analysis of discrete time signals. It is understood that these subbands have to be transformed back to the discrete time domain by corresponding synthesis filter bank operations. A signal block of L samples represents the signal in a time and frequency interval which is a part of the perceptually motivated tiling of the time-frequency plane which is applied for the description of signal properties. In this setting, the given audio objects can be represented as N rows of length L in a matrix, $$S = \begin{bmatrix} s_1(0) & s_1(1) & \cdots & s_1(L-1) \\ s_2(0) & s_2(1) & \cdots & s_2(L-1) \\ \vdots & \vdots & & \vdots \\ s_N(0) & s_N(1) & \cdots & s_N(L-1) \end{bmatrix}. \tag{2}$$

The downmix weight matrix D of size K×N where K>1 determines the K channel downmix signal in the form of a matrix with K rows through the matrix multiplication $$X=DS. \tag{3}$$

The user controlled object rendering matrix A of size M×N determines the M channel target rendering of the audio objects in the form of a matrix with M rows through the matrix multiplication $$Y=AS. \tag{4}$$

Disregarding for a moment the effects of core audio coding, the task of the SAOC decoder is to generate an approximation in the perceptual sense of the target rendering Y of the original audio objects, given the rendering matrix A, the downmix X the downmix matrix D, and object parameters.

The object parameters in the energy mode taught by the present invention carry information about the covariance of the original objects. In a deterministic version convenient for the subsequent derivation and also descriptive of the typical encoder operations, this covariance is given in unnormalized form by the matrix product SS* where the star denotes the complex conjugate transpose matrix operation. Hence, energy mode object parameters furnish a positive semi-definite N×N matrix E such that, possibly up to a scale factor, $$SS^* \approx E. \tag{5}$$

Prior art audio object coding frequently considers an object model where all objects are uncorrelated. In this case the matrix E is diagonal and contains only an approximation to the object energies $S_n=\|s_n\|^2$ for n=1,2, . . . ,N. The object parameter extractor according to FIG. 3, allows for an important refinement of this idea, particularly relevant in cases where the objects are furnished as stereo signals for which the assumptions on absence of correlation does not hold. A grouping of P selected stereo pairs of objects is described by the index sets $\{(n_p,m_p), p=1,2, \ldots ,P\}$. For these stereo pairs the correlation $\langle s_n,s_m\rangle$ is computed and the complex, real, or absolute value of the normalized correlation (ICC)

$$\rho_{n,m} = \frac{\langle s_n, s_m\rangle}{\|s_n\|\|s_m\|} \tag{6}$$

is extracted by the stereo parameter extractor 302. At the decoder, the ICC data can then be combined with the energies in order to form a matrix E with 2P off diagonal entries. For instance for a total of N=3 objects of which the first two consists a single pair (1,2), the transmitted energy and correlation data is $S_1$, $S_2$, $S_3$ and $\rho_{1,2}$. In this case, the combination into the matrix E yields $$E = \begin{bmatrix} S_1 & \rho_{1,2}\sqrt{S_1S_2} & 0 \\ \rho_{1,2}^*\sqrt{S_1S_2} & S_2 & 0 \\ 0 & 0 & S_3 \end{bmatrix}$$

The object parameters in the prediction mode taught by the present invention aim at making an N×K object prediction coefficient (OPC) matrix C available to the decoder such that $$S \approx CX = CDS. \tag{7}$$

In other words for each object there is a linear combination of the downmix channels such that the object can be recovered approximately by $$s_n(k) \approx c_{n,1}x_1(k) + \ldots + c_{n,K}x_K(k). \tag{8}$$

In an advantageous embodiment, the OPC extractor 401 solves the normal equations $$CXX^* = SX^*, \tag{9}$$

or, for the more attractive real valued OPC case, it solves $$CRe\{XC^*\} = Re\{SX^*\}. \tag{10}$$

In both cases, assuming a real valued downmix weight matrix D, and a non-singular downmix covariance, it follows by multiplication from the left with D that $$DC = I, \tag{11}$$

where I is the identity matrix of size K. If D has full rank it follows by elementary linear algebra that the set of solutions to (9) can be parameterized by max {K·(N−K), 0} parameters. This is exploited in the joint encoding in 402 of the OPC data. The full prediction matrix C can be recreated at the decoder from the reduced set of parameters and the downmix matrix.

For instance, consider for a stereo downmix (K=2) the case of three objects (N=3) comprising a stereo music track ($s_1$,$s_2$) and a center panned single instrument or voice track $s_3$. The downmix matrix is $$D = \begin{bmatrix} 1 & 0 & 1/\sqrt{2} \\ 0 & 1 & 1/\sqrt{2} \end{bmatrix}, \tag{12}$$

That is, the downmix left channel is $x_1 = s_1 + s_3/\sqrt{2}$ and the right channel is $x_2 = s_2 + s_3/\sqrt{2}$. The OPC's for the single track aim at approximating $s_3 \approx c_{31}x_1 + c_{32}x_2$ and the equation (11) can in this case be solved to achieve $c_{11} = 1 - c_{31}/\sqrt{2}$, $c_{12} = -c_{32}/\sqrt{2}$, $c_{21} = -c_{31}/\sqrt{2}$, and $c_{22} = 1 - c_{32}/\sqrt{2}$. Hence the number of OPC's which suffice is given by K(N−K)=2·(3−2)=2.

The OPC's $c_{31}$, $c_{32}$ can be found from the normal eauations $$[c_{31}, c_{32}]\begin{bmatrix} \|x_1\| & \langle x_1, x_2\rangle \\ \langle x_2, x_1\rangle & \|x_2\| \end{bmatrix} = [\langle s_3, x_1\rangle, \langle s_3, x_2\rangle]$$

SAOC to MPEG Surround Transcoder

Referring to FIG. 7, the M=6 output channels of the 5.1 configuration are ($y_1$, $y_2$, . . . , $y_6$)=($l_f$, $l_s$, $r_f$, $r_s$, c, lfe). The transcoder has to output a stereo downmix ($l_0$, $r_0$) and parameters for the TTT and OTT boxes. As the focus is now on stereo downmix it will be assumed in the following that K=2. As both the object parameters and the MPS TTT parameters exist in both an energy mode and a prediction mode, all four combinations have to be considered. The energy mode is a suitable choice for instance in case the downmix audio coder is not of waveform coder in the considered frequency interval. It is understood that the MPEG Surround parameters derived in the following text have to be properly quantized and coded prior to their transmission.

To further clarify the four combination mentioned above, these comprise

1. Object parameters in energy mode and transcoder in prediction mode
2. Object parameters in energy mode and transcoder in energy mode
3. Object parameters in prediction mode (OPC) and transcoder in prediction mode
4. Object parameters in prediction mode (OPC) and transcoder in energy mode If the downmix audio coder is a waveform coder in the considered frequency interval, the object parameters can be in both energy or prediction mode, but the transcoder should advantageously operate in prediction mode. If the downmix audio coder is not a waveform coder the in the considered frequency interval, the object encoder and the and the transcoder should both operate in energy mode. The fourth combination is of less relevance so the subsequent description will address the first three combinations only.

Object Parameters Given in Energy Mode

In energy mode, the data available to the transcoder is described by the triplet of matrices (D,E,A). The MPEG Surround OTT parameters are obtained by performing energy and correlation estimates on a virtual rendering derived from the transmitted parameters and the 6×N rendering matrix A. The six channel target covariance is given by $$YY^* = AS(AS)^* = A(SS^*)A^*, \tag{13}$$

Inserting (5) into (13) yields the approximation $$YY^* \approx F = AEA^*, \tag{14}$$

which is fully defined by the available data. Let $f_{kl}$ denote the elements of F. Then the CLD and ICC parameters are read from $$CLD_0 = 10\log_{10}\left(\frac{f_{55}}{f_{66}}\right), \tag{15}$$

$$CLD_1 = 10\log_{10}\left(\frac{f_{33}}{f_{44}}\right), \tag{16}$$

$$CLD_2 = 10\log_{10}\left(\frac{f_{11}}{f_{22}}\right), \tag{17}$$

$$ICC_1 = \frac{\varphi(f_{34})}{\sqrt{f_{33}f_{44}}}, \tag{18}$$

$$ICC_2 = \frac{\varphi(f_{12})}{\sqrt{f_{11}f_{22}}}, \tag{19}$$

where $\phi$ is either the absolute value $\phi(z)=|z|$ or real value operator $\phi(z)=\mathrm{Re}\{z\}$.

As an illustrative example, consider the case of three objects previously described in relation to equation (12). Let the rendering matrix be given by $$A=\begin{bmatrix}0&1&0\\0&1&0\\1&0&1\\1&0&0\\0&0&1\\0&0&1\end{bmatrix}.$$

The target rendering thus consists of placing object 1 between right front and right surround, object 2 between left front and left surround, and object 3 in both right front, center, and lfe. Assume also for simplicity that the three objects are uncorrelated and all have the same energy such that $$E=\begin{bmatrix}1&0&0\\0&1&0\\0&0&1\end{bmatrix}.$$

In this case, the right hand side of formula (14) becomes $$F=\begin{bmatrix}1&1&0&0&0&0\\1&1&0&0&0&0\\0&0&2&1&1&1\\0&0&1&1&0&0\\0&0&1&0&1&1\\0&0&1&0&1&1\end{bmatrix}.$$

Inserting the appropriate values into formulas (15)-(19) then yields $$CLD_0=10\log_{10}\left(\frac{f_{55}}{f_{66}}\right)=10\log_{10}\left(\frac{1}{1}\right)=0\text{ dB},$$

$$CLD_1=10\log_{10}\left(\frac{f_{33}}{f_{44}}\right)=10\log_{10}\left(\frac{2}{1}\right)=3\text{ dB},$$

$$CLD_2=10\log_{10}\left(\frac{f_{11}}{f_{22}}\right)=10\log_{10}\left(\frac{1}{1}\right)=0\text{ dB},$$

$$ICC_1=\frac{\varphi(f_{34})}{\sqrt{f_{33}f_{44}}}=\frac{\varphi(1)}{\sqrt{2\cdot 1}}=\frac{1}{\sqrt{2}},$$

$$ICC_2=\frac{\varphi(f_{12})}{\sqrt{f_{11}f_{22}}}=\frac{\varphi(1)}{\sqrt{1\cdot 1}}=1,$$

As a consequence, the MPEG surround decoder will be instructed to use some decorrelation between right front and right surround but no decorrelation between left front and left surround.

For the MPEG Surround TTT parameters in prediction mode, the first step is to form a reduced rendering matrix $A_3$ of size 3×N for the combined channels (l,r,qc) where $q=1/\sqrt{2}$. It holds that $A_3=D_{36}A$ where the 6 to 3 partial downmix matrix is defined by $$D_{36}=\begin{bmatrix}w_1&w_1&0&0&0&0\\0&0&w_2&w_2&0&0\\0&0&0&0&qw_3&qw_3\end{bmatrix}. \tag{20}$$

The partial downmix weights $w_p$, p=1,2,3 are adjusted such that the energy of $w_p(y_{2p-1}+y_{2p})$ is equal to the sum of energies $\|y_{2p-1}\|^2+\|y_{2p}\|^2$ up to a limit factor. All the data utilized to derive the partial downmix matrix $D_{36}$ is available in F. Next, a prediction matrix $C_3$ of size 3×2 is produced such that $$C_3X\approx A_3S, \tag{21}$$

Such a matrix is advantageously derived by considering first the normal equations $$C_3(DED^*)=A_3ED^*,$$

The solution to the normal equations yields the best possible waveform match for (21) given the object covariance model E. Some post processing of the matrix $C_3$ is advantageous, including row factors for a total or individual channel based prediction loss compensation.

To illustrate and clarify the steps above, consider a continuation of the specific six channel rendering example given above. In terms of the matrix elements of F, the downmix weights are solutions to the equations $$w_p^2(f_{2p-1,2p-1}+f_{2p,2p}+2f_{2p-1,2p})=f_{2p-1,2p-1}+f_{2p,2p},\ p=1,2,3,$$

which in the specific example becomes, $$\left\{\begin{matrix}w_1^2(1+1+2\cdot 1)=1+1\\w_2^2(2+1+2\cdot 1)=2+1\\w_3^2(1+1+2\cdot 1)=1+1\end{matrix}\right\},$$

Such that, $(w_1, w_2, w_3)=(1/\sqrt{2}, \sqrt{3/5}, 1/\sqrt{2})$. Insertion into (20) gives, $$A_3=D_{36}A=\begin{bmatrix}0&\sqrt{2}&0\\2\sqrt{\frac{3}{5}}&0&\sqrt{\frac{3}{5}}\\0&0&1\end{bmatrix}.$$

By solving the system of equations $C_3(DED^*)=A_3ED^*$ one then finds, (switching now to finite precision), $$C_3=\begin{bmatrix}-0.3536&1.0607\\1.4358&-0.1134\\0.3536&0.3536\end{bmatrix}.$$

The matrix $C_3$ contains the best weights for obtaining an approximation to the desired object rendering to the combined channels (l,r,qc) from the object downmix. This general type of matrix operation cannot be implemented by the MPEG surround decoder, which is tied to a limited space of TTT matrices through the use of only two parameters. The object of the inventive downmix converter is to pre-process the object downmix such that the combined effect of the pre-processing and the MPEG Surround TTT matrix is identical to the desired upmix described by $C_3$.

In MPEG Surround, the TTT matrix for prediction of (l,r,qc) from ($l_0$, $r_0$) is parameterized by three parameters ($\alpha,\beta,\gamma$) via $$C_{TTT} = \frac{\gamma}{3}\begin{bmatrix} \alpha+2 & \beta-1 \\ \alpha-1 & \beta+2 \\ 1-\alpha & 1-\beta \end{bmatrix}. \tag{22}$$

The downmix converter matrix G taught by the present invention is obtained by choosing $\gamma=1$ and solving the system of equations $$C_{TTT}G=C_3. \tag{23}$$

As it can easily be verified, it holds that $D_{TTT}C_{TTT}=I$ where I is the two by two identity matrix and $$D_{TTT} = \begin{bmatrix} 1 & 0 & 1 \\ 0 & 1 & 1 \end{bmatrix}. \tag{24}$$

Hence, a matrix multiplication from the left by $D_{TTT}$ of both sides of (23) leads to $$G=D_{TTT}C_3. \tag{25}$$

In the generic case, G will be invertible and (23) has a unique solution for $C_{TTT}$ which obeys $D_{TTT}C_{TTT}=I$. The TTT parameters ($\alpha$, $\beta$) are determined by this solution.

For the previously considered specific example, it can be easily verified that the solutions are given by $$G = \begin{bmatrix} 0 & 1.4142 \\ 1.7893 & 0.2401 \end{bmatrix} \text{ and } (\alpha, \beta) = (0.3506, 0.4072).$$

Note that a principal part of the stereo downmix is swapped between left and right for this converter matrix, which reflects the fact that the rendering example places objects that are in the left object downmix channel in right part of the sound scene and vice versa. Such behaviour is impossible to get from an MPEG Surround decoder in stereo mode.

If it is impossible to apply a downmix converter a suboptimal procedure can be developed as follows. For the MPEG Surround TTT parameters in energy mode, what is useful is the energy distribution of the combined channels (l,r,c). Therefore the relevant CLD parameters can be derived directly from the elements of F through $$CLD^0_{TTT} = 10\log_{10}\left(\frac{\|l\|^2+\|r\|^2}{\|c\|^2}\right) = 10\log_{10}\left(\frac{f_{11}+f_{22}+f_{33}+f_{44}}{f_{55}+f_{66}}\right), \tag{26}$$

$$CLD^1_{TTT} = 10\log_{10}\left(\frac{\|l\|^2}{\|r\|^2}\right) = 10\log_{10}\left(\frac{f_{11}+f_{22}}{f_{33}+f_{44}}\right). \tag{27}$$

In this case, it is suitable to use only a diagonal matrix G with positive entries for the downmix converter. It is operational to achieve the correct energy distribution of the downmix channels prior to the TTT upmix. With the six to two channel downmix matrix $D_{26}=D_{TTT}D_{36}$ and the definitions from $$i\ Z=DED^*, \tag{28}$$

$$W=D_{26}ED^*_{26}, \tag{29}$$

one chooses simply $$G = \begin{bmatrix} \sqrt{w_{11}/z_{11}} & 0 \\ 0 & \sqrt{w_{22}/z_{22}} \end{bmatrix}. \tag{30}$$

A further observation is that such a diagonal form downmix converter can be omitted from the object to MPEG Surround transcoder and implemented by means of activating the arbitrary downmix gain (ADG) parameters of the MPEG Surround decoder. Those gains will be the be given in the logarithmic domain by $ADG_i=10\log_{10}(w_{11}/z_{11})$ for i=1,2.

Object Parameters Given in Prediction (OPC) Mode

In object prediction mode, the available data is represented by the matrix triplet (D,C,A) where C is the N×2 matrix holding the N pairs of OPC's. Due to the relative nature of prediction coefficients, it will further be useful for the estimation of energy based MPEG Surround parameters to have access to an approximation to the 2×2 covariance matrix of the object downmix, $$XX^*\approx Z. \tag{31}$$

This information is advantageously transmitted from the object encoder as part of the downmix side information, but it could also be estimated at the transcoder from measurements performed on the received downmix, or indirectly derived from (D,C) by approximate object model considerations. Given Z, the object covariance can be estimated by inserting the predictive model Y=CX, yielding $$E=CZC^*, \tag{32}$$

and all the MPEG Surround OTT and energy mode ITT parameters can be estimated from E as in the case of energy based object parameters. However, the great advantage of using OPC's arises in combination with MPEG Surround TTT parameters in prediction mode. In this case, the waveform approximation $D_{36}Y\approx A_3CX$ immediately gives the reduced prediction matrix $$C_3=A_3C, \tag{32}$$

from which the remaining steps to achieve the TTT parameters ($\alpha$, $\beta$) and the downmix converter are similar to the case of object parameters given in energy mode. In fact, the steps of formulas (22) to (25) are completely identical. The resulting matrix G is fed to the downmix converter and the TTT parameters ($\alpha$, $\beta$) are transmitted to the MPEG Surround decoder.

Stand Alone Application of the Downmix Converter for Stereo Rendering

In all cases described above the object to stereo downmix converter 501 outputs an approximation to a stereo downmix of the 5.1 channel rendering of the audio objects. This stereo rendering can be expressed by a 2×N matrix $A_2$ defined by $A_2=D_{26}A$. In many applications this downmix is interesting in its own right and a direct manipulation of the stereo rendering $A_2$ is attractive. Consider as an illustrative example again the case of a stereo track with a superimposed center panned mono voice track encoded by following a special case of the method outlined in FIG. 8 and discussed in the section around formula (12). A user control of the voice volume can be realized by the rendering $$A_2 = \frac{1}{\sqrt{1+v^2}}\begin{bmatrix} 1 & 0 & v/\sqrt{2} \\ 0 & 1 & v/\sqrt{2} \end{bmatrix}, \tag{33}$$

where ν is the voice to music quotient control. The design of the downmix converter matrix is based on $$GDS \approx A_2 S. \tag{34}$$

For the prediction based object parameters, one simply inserts the approximation $S \approx CDS$ and obtain the converter matrix $G \approx A_2 C$. For energy based object parameters, one solves the normal equations $$G(DED^*) = A_2 ED^*. \tag{35}$$

Figure 9:
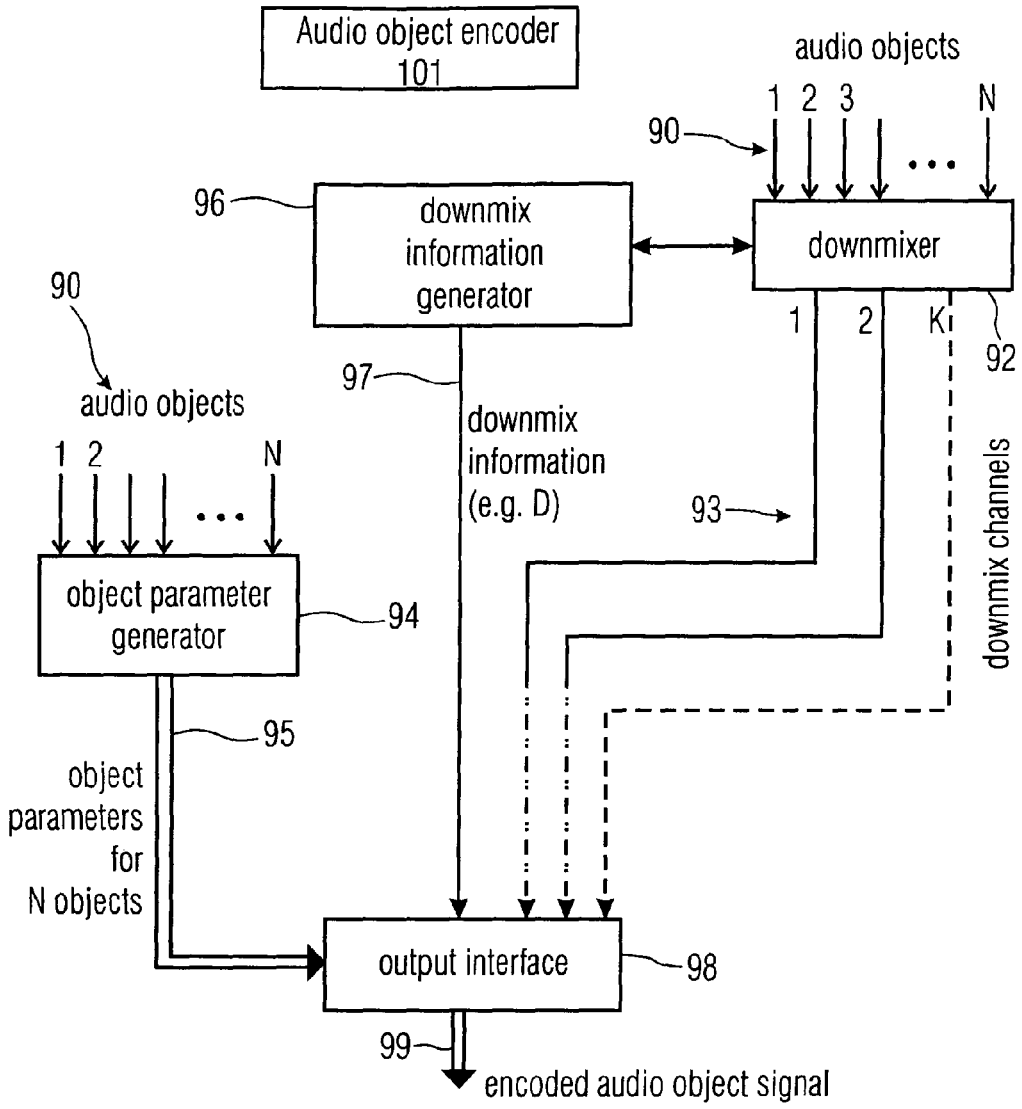
FIG. 9 illustrates an encoder embodiment.

FIG. 9 illustrates an advantageous embodiment of an audio object coder in accordance with one aspect of the present invention. The audio object encoder 101 has already been generally described in connection with the preceding figures. The audio object coder for generating the encoded object signal uses the plurality of audio objects 90 which have been indicated in FIG. 9 as entering a downmixer 92 and an object parameter generator 94. Furthermore, the audio object encoder 101 includes the downmix information generator 96 for generating downmix information 97 indicating a distribution of the plurality of audio objects into at least two downmix channels indicated at 93 as leaving the downmixer 92.

The object parameter generator is for generating object parameters 95 for the audio objects, wherein the object parameters are calculated such that the reconstruction of the audio object is possible using the object parameters and at least two downmix channels 93. Importantly, however, this reconstruction does not take place on the encoder side, but takes place on the decoder side. Nevertheless, the encoder-side object parameter generator calculates the object parameters for the objects 95 so that this full reconstruction can be performed on the decoder side.

Furthermore, the audio object encoder 101 includes an output interface 98 for generating the encoded audio object signal 99 using the downmix information 97 and the object parameters 95. Depending on the application, the downmix channels 93 can also be used and encoded into the encoded audio object signal. However, there can also be situations in which the output interface 98 generates an encoded audio object signal 99 which does not include the downmix channels. This situation may arise when any downmix channels to be used on the decoder side are already at the decoder side, so that the downmix information and the object parameters for the audio objects are transmitted separately from the downmix channels. Such a situation is useful when the object downmix channels 93 can be purchased separately from the object parameters and the downmix information for a smaller amount of money, and the object parameters and the downmix information can be purchased for an additional amount of money in order to provide the user on the decoder side with an added value.

Without the object parameters and the downmix information, a user can render the downmix channels as a stereo or multi-channel signal depending on the number of channels included in the downmix. Naturally, the user could also render a mono signal by simply adding the at least two transmitted object downmix channels. To increase the flexibility of rendering and listening quality and usefulness, the object parameters and the downmix information enable the user to form a flexible rendering of the audio objects at any intended audio reproduction setup, such as a stereo system, a multi-channel system or even a wave field synthesis system. While wave field synthesis systems are not yet very popular, multi-channel systems such as 5.1 systems or 7.1 systems are becoming increasingly popular on the consumer market.

Figure 10:
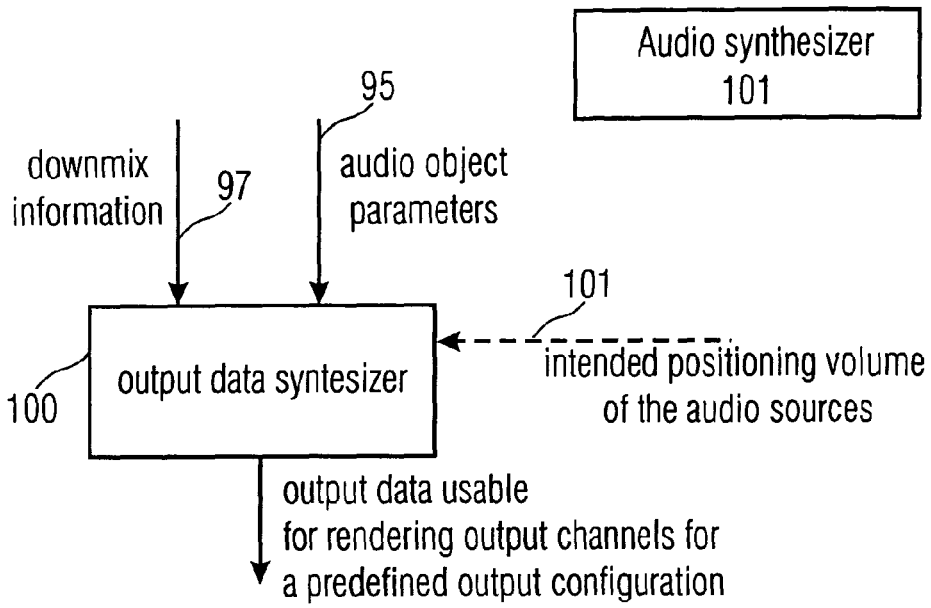
FIG. 10 illustrates a decoder embodiment.

FIG. 10 illustrates an audio synthesizer for generating output data. To this end, the audio synthesizer includes an output data synthesizer 100. The output data synthesizer receives, as an input, the down-mix information 97 and audio object parameters 95 and, probably, intended audio source data such as a positioning of the audio sources or a user-specified volume of a specific source, which the source should have been when rendered as indicated at 101.

The output data synthesizer 100 is for generating output data usable for creating a plurality of output channels of a predefined audio output configuration representing a plurality of audio objects. Particularly, the output data synthesizer 100 is operative to use the downmix information 97, and the audio object parameters 95. As discussed in connection with FIG. 11 later on, the output data can be data of a large variety of different useful applications, which include the specific rendering of output channels or which include just a reconstruction of the source signals or which include a transcoding of parameters into spatial rendering parameters for a spatial upmixer configuration without any specific rendering of output channels, but e.g. for storing or transmitting such spatial parameters.

Figure 14:
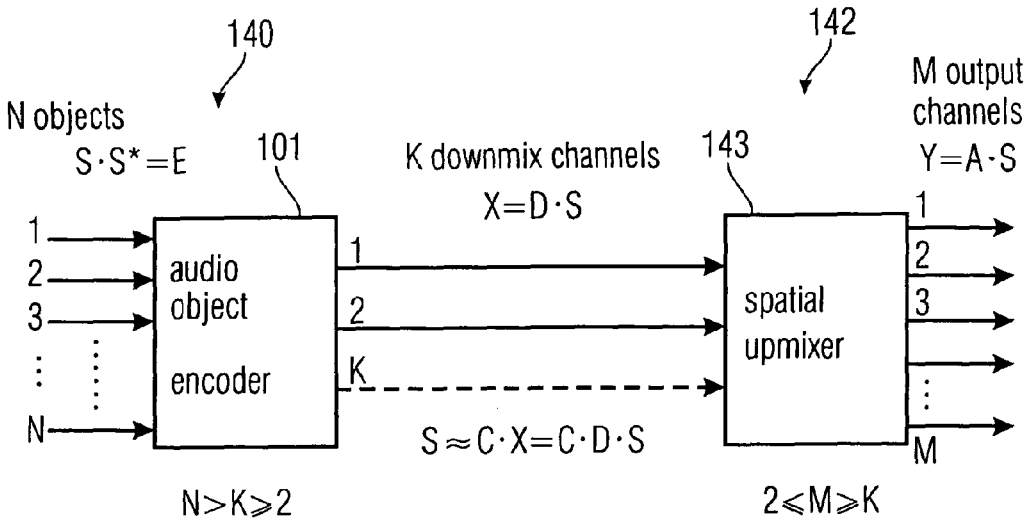
FIG. 14 illustrates a general overview of an encoder/decoder system.

The general application scenario of the present invention is summarized in FIG. 14. There is an encoder side 140 which includes the audio object encoder 101 which receives, as an input, N audio objects. The output of the advantageous audio object encoder comprises, in addition to the downmix information and the object parameters which are not shown in FIG. 14, the K downmix channels. The number of downmix channels in accordance with the present invention is greater than or equal to two.

The downmix channels are transmitted to a decoder side 142, which includes a spatial upmixer 143. The spatial upmixer 143 may include the inventive audio synthesizer, when the audio synthesizer is operated in a transcoder mode. When the audio synthesizer 101 as illustrated in FIG. 10, however, works in a spatial upmixer mode, then the spatial upmixer 143 and the audio synthesizer are the same device in this embodiment. The spatial upmixer generates M output channels to be played via M speakers. These speakers are positioned at predefined spatial locations and together represent the predefined audio output configuration. An output channel of the predefined audio output configuration may be seen as a digital or analog speaker signal to be sent from an output of the spatial upmixer 143 to the input of a loudspeaker at a predefined position among the plurality of predefined positions of the predefined audio output configuration. Depending on the situation, the number of M output channels can be equal to two when stereo rendering is performed. When, however, a multi-channel rendering is performed, then the number of M output channels is larger than two. Typically, there will be a situation in which the number of downmix channels is smaller than the number of output channels due to a requirement of a transmission link. In this case, M is larger than K and may even be much larger than K, such as double the size or even more.

FIG. 14 furthermore includes several matrix notations in order to illustrate the functionality of the inventive encoder side and the inventive decoder side. Generally, blocks of sampling values are processed. Therefore, as is indicated in equation (2), an audio object is represented as a line of L sampling values. The matrix S has N lines corresponding to the number of objects and L columns corresponding to the number of samples. The matrix E is calculated as indicated in equation (5) and has N columns and N lines. The matrix E includes the object parameters when the object parameters are given in the energy mode. For uncorrelated objects, the matrix E has, as indicated before in connection with equation (6) only main diagonal elements, wherein a main diagonal element gives the energy of an audio object. All off-diagonal elements represent, as indicated before, a correlation of two audio objects, which is specifically useful when some objects are two channels of the stereo signal.

Depending on the specific embodiment, equation (2) is a time domain signal. Then a single energy value for the whole band of audio objects is generated. Preferably, however, the audio objects are processed by a time/frequency converter which includes, for example, a type of a transform or a filter bank algorithm. In the latter case, equation (2) is valid for each subband so that one obtains a matrix E for each subband and, of course, each time frame.

The downmix channel matrix X has K lines and L columns and is calculated as indicated in equation (3). As indicated in equation (4), the M output channels are calculated using the N objects by applying the so-called rendering matrix A to the N objects. Depending on the situation, the N objects can be regenerated on the decoder side using the downmix and the object parameters and the rendering can be applied to the reconstructed object signals directly.

Alternatively, the downmix can be directly transformed to the output channels without an explicit calculation of the source signals. Generally, the rendering matrix A indicates the positioning of the individual sources with respect to the predefined audio output configuration. If one had six objects and six output channels, then one could place each object at each output channel and the rendering matrix would reflect this scheme. If, however, one would like to place all objects between two output speaker locations, then the rendering matrix A would look different and would reflect this different situation.

The rendering matrix or, more generally stated, the intended positioning of the objects and also an intended relative volume of the audio sources can in general be calculated by an encoder and transmitted to the decoder as a so-called scene description. In other embodiments, however, this scene description can be generated by the user herself/himself for generating the user-specific upmix for the user-specific audio output configuration. A transmission of the scene description is, therefore, not absolutely necessary, but the scene description can also be generated by the user in order to fulfill the wishes of the user. The user might, for example, like to place certain audio objects at places which are different from the places where these objects were when generating these objects. There are also cases in which the audio objects are designed by themselves and do not have any "original" location with respect to the other objects. In this situation, the relative location of the audio sources is generated by the user at the first time.

Reverting to FIG. 9, a downmixer 92 is illustrated. The downmixer is for downmixing the plurality of audio objects into the plurality of downmix channels, wherein the number of audio objects is larger than the number of downmix channels, and wherein the downmixer is coupled to the downmix information generator so that the distribution of the plurality of audio objects into the plurality of downmix channels is conducted as indicated in the downmix information. The downmix information generated by the downmix information generator 96 in FIG. 9 can be automatically created or manually adjusted. It is advantageous to provide the downmix information with a resolution smaller than the resolution of the object parameters. Thus, side information bits can be saved without major quality losses, since fixed downmix information for a certain audio piece or an only slowly changing downmix situation which need not necessarily be frequency-selective has proved to be sufficient. In one embodiment, the downmix information represents a downmix matrix having K lines and N columns.

The value in a line of the downmix matrix has a certain value when the audio object corresponding to this value in the downmix matrix is in the downmix channel represented by the row of the downmix matrix. When an audio object is included into more than one downmix channels, the values of more than one row of the downmix matrix have a certain value. However, it is advantageous that the squared values when added together for a single audio object sum up to 1.0. Other values, however, are possible as well. Additionally, audio objects can be input into one or more downmix channels with varying levels, and these levels can be indicated by weights in the downmix matrix which are different from one and which do not add up to 1.0 for a certain audio object.

When the downmix channels are included in the encoded audio object signal generated by the output interface 98, the encoded audio object signal may be for example a time-multiplex signal in a certain format. Alternatively, the encoded audio object signal can be any signal which allows the separation of the object parameters 95, the downmix information 97 and the downmix channels 93 on a decoder side. Furthermore, the output interface 98 can include encoders for the object parameters, the downmix information or the downmix channels. Encoders for the object parameters and the downmix information may be differential encoders and/or entropy encoders, and encoders for the downmix channels can be mono or stereo audio encoders such as MP3 encoders or AAC encoders. All these encoding operations result in a further data compression in order to further decrease the data rate used for the encoded audio object signal 99.

Depending on the specific application, the downmixer 92 is operative to include the stereo representation of background music into the at least two downmix channels and furthermore introduces the voice track into the at least two downmix channels in a predefined ratio. In this embodiment, a first channel of the background music is within the first downmix channel and the second channel of the background music is within the second downmix channel. This results in an optimum replay of the stereo background music on a stereo rendering device. The user can, however, still modify the position of the voice track between the left stereo speaker and the right stereo speaker. Alternatively, the first and the second background music channels can be included in one downmix channel and the voice track can be included in the other downmix channel. Thus, by eliminating one downmix channel, one can fully separate the voice track from the background music which is particularly suited for karaoke applications. However, the stereo reproduction quality of the background music channels will suffer due to the object parameterization which is, of course, a lossy compression method.

A downmixer 92 is adapted to perform a sample by sample addition in the time domain. This addition uses samples from audio objects to be downmixed into a single downmix channel. When an audio object is to be introduced into a downmix channel with a certain percentage, a pre-weighting is to take place before the sample-wise summing process. Alternatively, the summing can also take place in the frequency domain, or a subband domain, i.e., in a domain subsequent to the time/frequency conversion. Thus, one could even perform the downmix in the filter bank domain when the time/frequency conversion is a filter bank or in the transform domain when the time/frequency conversion is a type of FFT, MDCT or any other transform.

Figure 15:
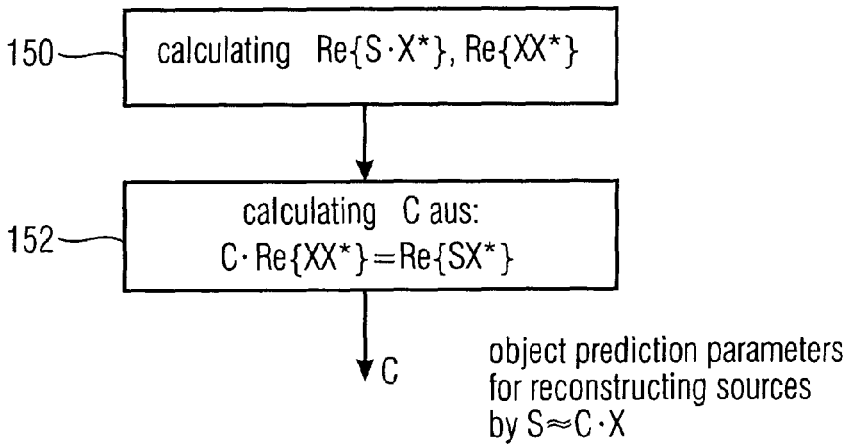
FIG. 15 illustrates a method of calculating prediction object parameters.

In one aspect of the present invention, the object parameter generator 94 generates energy parameters and, additionally, correlation parameters between two objects when two audio objects together represent the stereo signal as becomes clear by the subsequent equation (6). Alternatively, the object parameters are prediction mode parameters. FIG. 15 illustrates algorithm steps or means of a calculating device for calculating these audio object prediction parameters. As has been discussed in connection with equations (7) to (12), some statistical information on the downmix channels in the matrix X and the audio objects in the matrix S has to be calculated. Particularly, block 150 illustrates the first step of calculating the real part of $S \cdot X^*$ and the real part of $X \cdot X^*$. These real parts are not just numbers but are matrices, and these matrices are determined in one embodiment via the notations in equation (1) when the embodiment subsequent to equation (12) is considered. Generally, the values of step 150 can be calculated using available data in the audio object encoder 101. Then, the prediction matrix C is calculated as illustrated in step 152. Particularly, the equation system is solved as known in the art so that all values of the prediction matrix C which has N lines and K columns are obtained. Generally, the weighting factors $c_{n,i}$ as given in equation (8) are calculated such that the weighted linear addition of all downmix channels reconstructs a corresponding audio object as well as possible. This prediction matrix results in a better reconstruction of audio objects when the number of downmix channels increases.

Subsequently, FIG. 11 will be discussed in more detail. Particularly, FIG. 7 illustrates several kinds of output data usable for creating a plurality of output channels of a predefined audio output configuration. Line 111 illustrates a situation in which the output data of the output data synthesizer 100 are reconstructed audio sources. The input data utilized by the output data synthesizer 100 for rendering the reconstructed audio sources include downmix information, the downmix channels and the audio object parameters. For rendering the reconstructed sources, however, an output configuration and an intended positioning of the audio sources themselves in the spatial audio output configuration are not absolutely necessary. In this first mode indicated by mode number 1 in FIG. 11, the output data synthesizer 100 would output reconstructed audio sources. In the case of prediction parameters as audio object parameters, the output data synthesizer 100 works as defined by equation (7). When the object parameters are in the energy mode, then the output data synthesizer uses an inverse of the downmix matrix and the energy matrix for reconstructing the source signals.

Alternatively, the output data synthesizer 100 operates as a transcoder as illustrated for example in block 102 in FIG. 1*b*. When the output synthesizer is a type of a transcoder for generating spatial mixer parameters, the downmix information, the audio object parameters, the output configuration and the intended positioning of the sources are useful. Particularly, the output configuration and the intended positioning are provided via the rendering matrix A. However, the downmix channels are not required for generating the spatial mixer parameters as will be discussed in more detail in connection with FIG. 12. Depending on the situation, the spatial mixer parameters generated by the output data synthesizer 100 can then be used by a straight-forward spatial mixer such as an MPEG-surround mixer for upmixing the downmix channels. This embodiment does not necessarily need to modify the object downmix channels, but may provide a simple conversion matrix only having diagonal elements as discussed in equation (13). In mode 2 as indicated by 112 in FIG. 11, the output data synthesizer 100 would, therefore, output spatial mixer parameters and, advantageously, the conversion matrix G as indicated in equation (13), which includes gains that can be used as arbitrary downmix gain parameters (ADG) of the MPEG-surround decoder.

In mode number 3 as indicated by 113 of FIG. 11, the output data include spatial mixer parameters at a conversion matrix such as the conversion matrix illustrated in connection with equation (25). In this situation, the output data synthesizer 100 does not necessarily have to perform the actual downmix conversion to convert the object downmix into a stereo downmix.

A different mode of operation indicated by mode number 4 in line 114 in FIG. 11 illustrates the output data synthesizer 100 of FIG. 10. In this situation, the transcoder is operated as indicated by 102 in FIG. 1*b* and outputs not only spatial mixer parameters but additionally outputs a converted downmix. However, it is not necessary anymore to output the conversion matrix G in addition to the converted downmix. Outputting the converted downmix and the spatial mixer parameters is sufficient as indicated by FIG. 1*b*.

Mode number 5 indicates another usage of the output data synthesizer 100 illustrated in FIG. 10. In this situation indicated by line 115 in FIG. 11, the output data generated by the output data synthesizer do not include any spatial mixer parameters but only include a conversion matrix G as indicated by equation (35) for example or actually includes the output of the stereo signals themselves as indicated at 115. In this embodiment, only a stereo rendering is of interest and any spatial mixer parameters are not required. For generating the stereo output, however, all available input information as indicated in FIG. 11 is useful.

Another output data synthesizer mode is indicated by mode number 6 at line 116. Here, the output data synthesizer 100 generates a multi-channel output, and the output data synthesizer 100 would be similar to element 104 in FIG. 1*b*. To this end, the output data synthesizer 100 uses all available input information and outputs a multi-channel output signal having more than two output channels to be rendered by a corresponding number of speakers to be positioned at intended speaker positions in accordance with the predefined audio output configuration. Such a multi-channel output is a 5.1 output, a 7.1 output or only a 3.0 output having a left speaker, a center speaker and a right speaker.

Subsequently, reference is made to FIG. 11 for illustrating one example for calculating several parameters from the FIG. 7 parameterization concept known from the MPEG-surround decoder. As indicated, FIG. 7 illustrates an MPEG-surround decoder-side parameterization starting from the stereo downmix 70 having a left downmix channel $l_0$ and a right downmix channel $r_0$. Conceptually, both downmix channels are input into a so-called Two-To-Three box 71. The Two-To-Three box is controlled by several input parameters 72. Box 71 generates three output channels 73*a*, 73*b*, 73*c*. Each output channel is input into a One-To-Two box. This means that channel 73*a* is input into box 74*a*, channel 73*b* is input into box 74*b*, and channel 73*c* is input into box 74*c*. Each box outputs two output channels. Box 74*a* outputs a left front channel $l_f$ and a left surround channel $l_s$. Furthermore, box 74*b* outputs a right front channel $r_f$ and a right surround channel $r_s$. Furthermore, box 74*c* outputs a center channel c and a low-frequency enhancement channel lfe. Importantly, the whole upmix from the downmix channels 70 to the output channels is performed using a matrix operation, and the tree structure as shown in FIG. 7 is not necessarily implemented step by step but can be implemented via a single or several matrix operations. Furthermore, the intermediate signals indicated by 73*a*, 73*b* and 73*c* are not explicitly calculated by a certain embodiment, but are illustrated in FIG. 7 only for illustration purposes. Furthermore, boxes 74*a*, 74*b* receive some residual signals $res_1^{OTT}$, $res_2^{OTT}$ which can be used for introducing a certain randomness into the output signals.

Figure 12:
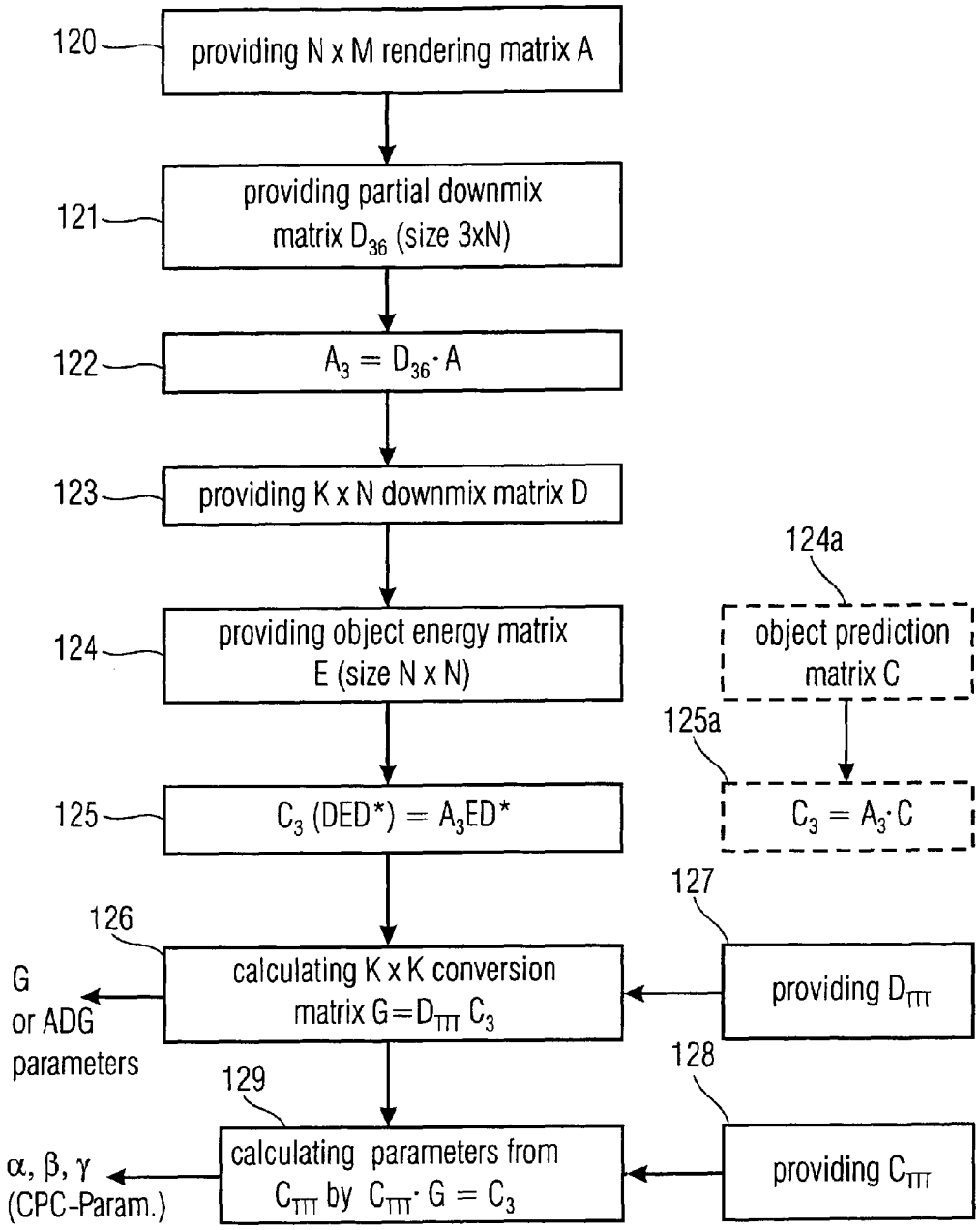
FIG. 12 illustrates a method for calculating certain spatial upmix parameters.
Figure 13A:
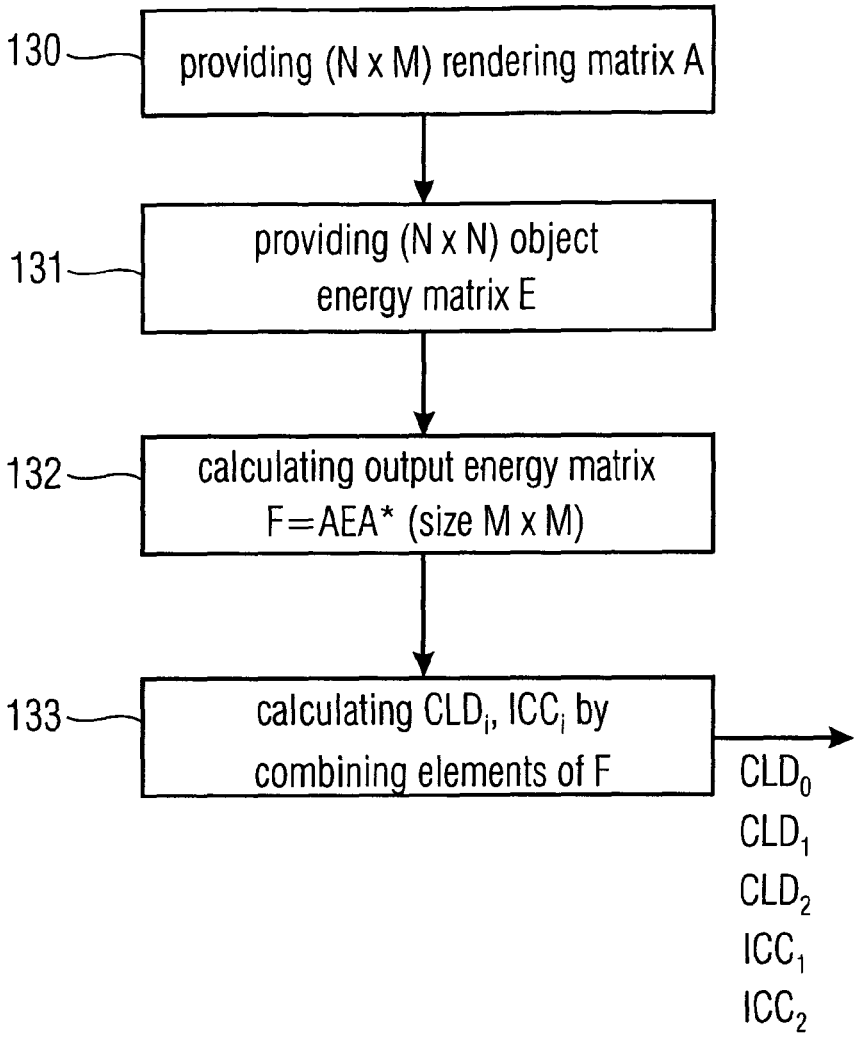
FIG. 13*a* illustrates a method for calculating additional spatial upmix parameters.

As known from the MPEG-surround decoder, box 71 is controlled either by prediction parameters CPC or energy parameters $CLD_{TTT}$. For the upmix from two channels to three channels, at least two prediction parameters CPC1, CPC2 or at least two energy parameters $CLD^1_{TTT}$ and $CLD^2_{TTT}$ are useful. Furthermore, the correlation measure $ICC_{TTT}$ can be put into the box 71 which is, however, only an optional feature which is not used in one embodiment of the invention. FIGS. 12 and 13 illustrate the steps and/or means for calculating all parameters CPC/$CLD_{TTT}$, CLD0, CLD1, ICC1, CLD2, ICC2 from the object parameters 95 of FIG. 9, the downmix information 97 of FIG. 9 and the intended positioning of the audio sources, e.g. the scene description 101 as illustrated in FIG. 10. These parameters are for the predefined audio output format of a 5.1 surround system.

Naturally, the specific calculation of parameters for this specific implementation can be adapted to other output formats or parameterizations in view of the teachings of this document. Furthermore, the sequence of steps or the arrangement of means in FIGS. 12 and 13*a,b* is only exemplarily and can be changed within the logical sense of the mathematical equations.

In step 120, a rendering matrix A is provided. The rendering matrix indicates where the source of the plurality of sources is to be placed in the context of the predefined output configuration. Step 121 illustrates the derivation of the partial downmix matrix $D_{36}$ as indicated in equation (20). This matrix reflects the situation of a downmix from six output channels to three channels and has a size of 3×N. When one intends to generate more output channels than the 5.1 configuration, such as an 8-channel output configuration (7.1), then the matrix determined in block 121 would be a $D_{38}$ matrix. In step 122, a reduced rendering matrix $A_3$ is generated by multiplying matrix $D_{36}$ and the full rendering matrix as defined in step 120. In step 123, the downmix matrix D is introduced. This downmix matrix D can be retrieved from the encoded audio object signal when the matrix is fully included in this signal. Alternatively, the downmix matrix could be parameterized e.g. for the specific downmix information example and the downmix matrix G.

Furthermore, the object energy matrix is provided in step 124. This object energy matrix is reflected by the object parameters for the N objects and can be extracted from the imported audio objects or reconstructed using a certain reconstruction rule. This reconstruction rule may include an entropy decoding etc.

In step 125, the "reduced" prediction matrix $C_3$ is defined. The values of this matrix can be calculated by solving the system of linear equations as indicated in step 125. Specifically, the elements of matrix $C_3$ can be calculated by multiplying the equation on both sides by an inverse of (DED*).

In step 126, the conversion matrix G is calculated. The conversion matrix G has a size of KxK and is generated as defined by equation (25). To solve the equation in step 126, the specific matrix $D_{TTT}$ is to be provided as indicated by step 127. An example for this matrix is given in equation (24) and the definition can be derived from the corresponding equation for $C_{TTT}$ as defined in equation (22). Equation (22), therefore, defines what is to be done in step 128. Step 129 defines the equations for calculating matrix $C_{TTT}$. As soon as matrix $C_{TTT}$ is determined in accordance with the equation in block 129, the parameters α, β and γ, which are the CPC parameters, can be output. Preferably, γ is set to 1 so that the only remaining CPC parameters input into block 71 are α and β.

The remaining parameters for the scheme in FIG. 7 are the parameters input into blocks 74*a*, 74*b* and 74*c*. The calculation of these parameters is discussed in connection with FIG. 13*a*. In step 130, the rendering matrix A is provided. The size of the rendering matrix A is N lines for the number of audio objects and M columns for the number of output channels. This rendering matrix includes the information from the scene vector, when a scene vector is used. Generally, the rendering matrix includes the information of placing an audio source in a certain position in an output setup. When, for example, the rendering matrix A below equation (19) is considered, it becomes clear how a certain placement of audio objects can be coded within the rendering matrix. Naturally, other ways of indicating a certain position can be used, such as by values not equal to 1. Furthermore, when values are used which are smaller than 1 on the one hand and are larger than 1 on the other hand, the loudness of the certain audio objects can be influenced as well.

In one embodiment, the rendering matrix is generated on the decoder side without any information from the encoder side. This allows a user to place the audio objects wherever the user likes without paying attention to a spatial relation of the audio objects in the encoder setup. In another embodiment, the relative or absolute location of audio sources can be encoded on the encoder side and transmitted to the decoder as a kind of a scene vector. Then, on the decoder side, this information on locations of audio sources which is advantageously independent of an intended audio rendering setup is processed to result in a rendering matrix which reflects the locations of the audio sources customized to the specific audio output configuration.

In step 131, the object energy matrix E which has already been discussed in connection with step 124 of FIG. 12 is provided. This matrix has the size of N×N and includes the audio object parameters. In one embodiment such an object energy matrix is provided for each subband and each block of time-domain samples or subband-domain samples.

In step 132, the output energy matrix F is calculated. F is the covariance matrix of the output channels. Since the output channels are, however, still unknown, the output energy matrix F is calculated using the rendering matrix and the energy matrix. These matrices are provided in steps 130 and 131 and are readily available on the decoder side. Then, the specific equations (15), (16), (17), (18) and (19) are applied to calculate the channel level difference parameters $CLD_0$, $CLD_1$, $CLD_2$ and the inter-channel coherence parameters $ICC_1$ and $ICC_2$ so that the parameters for the boxes 74*a*, 74*b*, 74*c* are available. Importantly, the spatial parameters are calculated by combining the specific elements of the output energy matrix F.

Subsequent to step 133, all parameters for a spatial upmixer, such as the spatial upmixer as schematically illustrated in FIG. 7, are available.

In the preceding embodiments, the object parameters were given as energy parameters. When, however, the object parameters are given as prediction parameters, i.e. as an object prediction matrix C as indicated by item 124*a* in FIG. 12, the calculation of the reduced prediction matrix $C_3$ is just a matrix multiplication as illustrated in block 125*a* and discussed in connection with equation (32). The matrix $A_3$ as used in block 125*a* is the same matrix $A_3$ as mentioned in block 122 of FIG. 12.

Figure 13B:
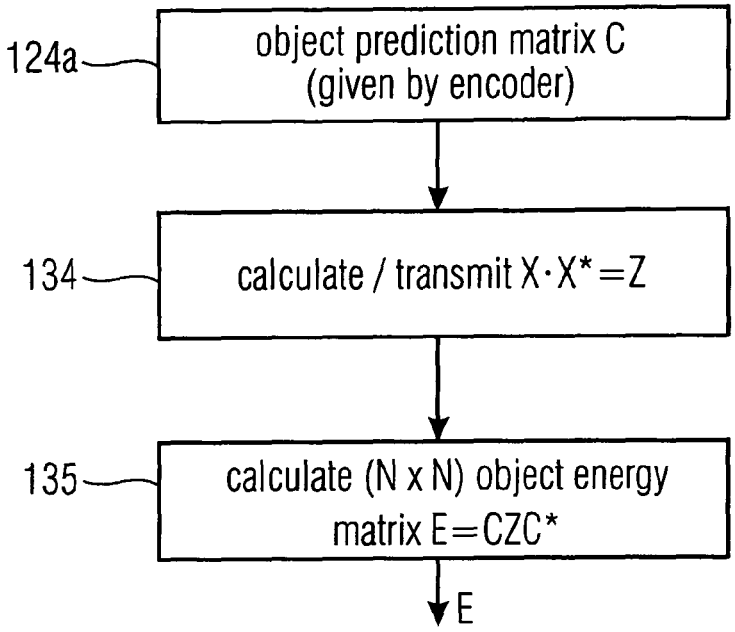
FIG. 13*b* illustrates a method for calculating using prediction parameters.

When the object prediction matrix C is generated by an audio object encoder and transmitted to the decoder, then some additional calculations are useful for generating the parameters for the boxes 74*a*, 74*b*, 74*c*. These additional steps are indicated in FIG. 13*b*. Again, the object prediction matrix C is provided as indicated by 124*a* in FIG. 13*b*, which is the same as discussed in connection with block 124*a* of FIG. 12. Then, as discussed in connection with equation (31), the covariance matrix of the object downmix Z is calculated using the transmitted downmix or is generated and transmitted as additional side information. When information on the matrix Z is transmitted, then the decoder does not necessarily have to perform any energy calculations which inherently introduce some delayed processing and increase the processing load on the decoder side. When, however, these issues are not decisive for a certain application, then transmission bandwidth can be saved and the covariance matrix Z of the object downmix can also be calculated using the downmix samples which are, of course, available on the decoder side. As soon as step 134 is completed and the covariance matrix of the object downmix is ready, the object energy matrix E can be calculated as indicated by step 135 by using the prediction matrix C and the downmix covariance or "downmix energy" matrix Z. As soon as step 135 is completed, all steps discussed in connection with FIG. 13*a* can be performed, such as steps 132, 133, to generate all parameters for blocks 74*a*, 74*b*, 74*c* of FIG. 7.

Figure 16:
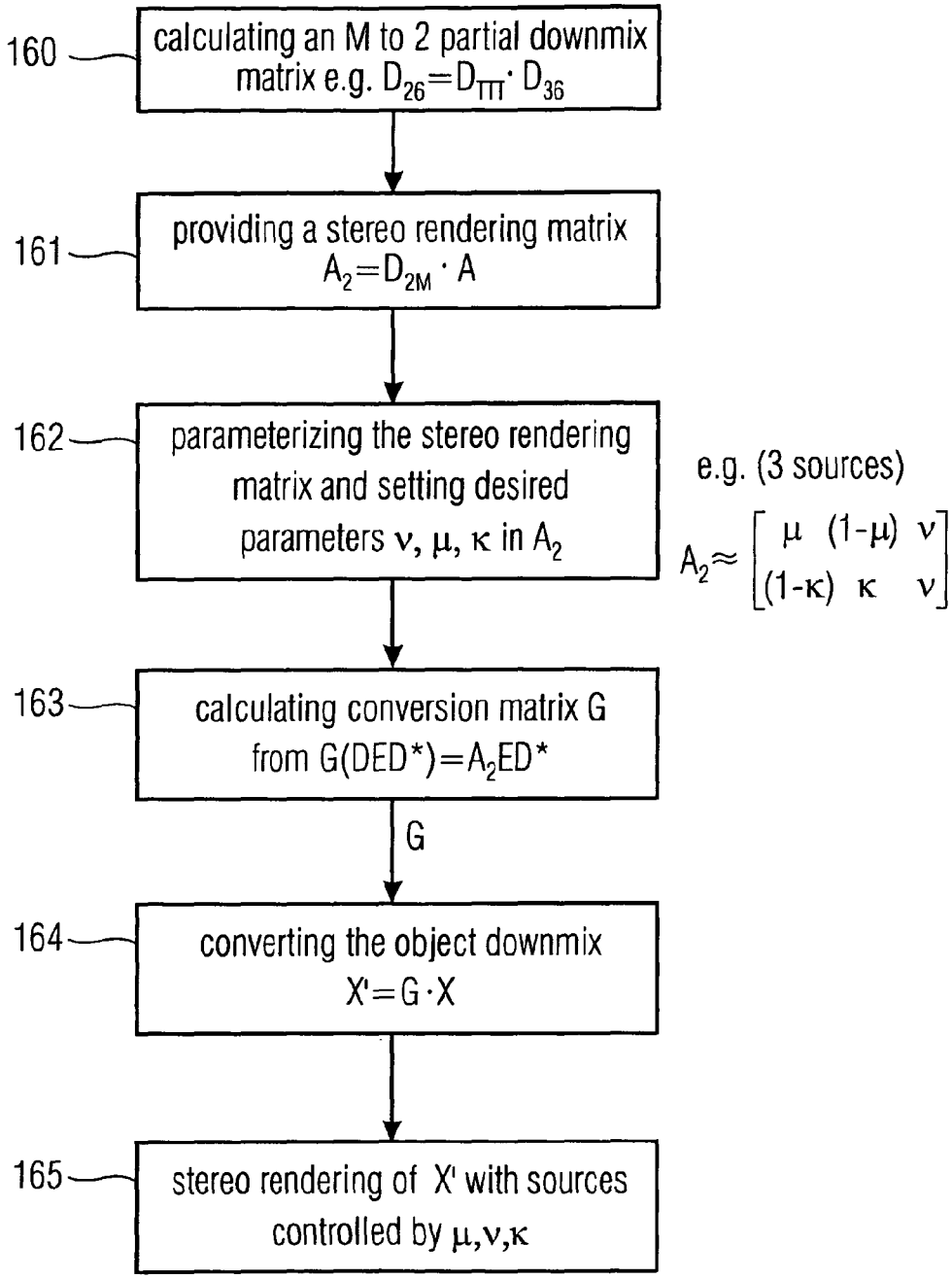
FIG. 16 illustrates a method of stereo rendering.

FIG. 16 illustrates a further embodiment, in which only a stereo rendering is used. The stereo rendering is the output as provided by mode number 5 or line 115 of FIG. 11. Here, the output data synthesizer 100 of FIG. 10 is not interested in any spatial upmix parameters but is mainly interested in a specific conversion matrix G for converting the object downmix into a useful and, of course, readily influencable and readily controllable stereo downmix.

In step 160 of FIG. 16, an M-to-2 partial downmix matrix is calculated. In the case of six output channels, the partial downmix matrix would be a downmix matrix from six to two channels, but other downmix matrices are available as well. The calculation of this partial downmix matrix can be, for example, derived from the partial downmix matrix $D_{36}$ as generated in step 121 and matrix $D_{TTT}$ as used in step 127 of FIG. 12.

Furthermore, a stereo rendering matrix $A_2$ is generated using the result of step 160 and the "big" rendering matrix A is illustrated in step 161. The rendering matrix A is the same matrix as has been discussed in connection with block 120 in FIG. 12.

Subsequently, in step 162, the stereo rendering matrix may be parameterized by placement parameters μ and κ. When μ is set to 1 and κ is set to 1 as well, then the equation (33) is obtained, which allows a variation of the voice volume in the example described in connection with equation (33). When, however, other parameters such as μ and κ are used, then the placement of the sources can be varied as well.

Then, as indicated in step 163, the conversion matrix G is calculated by using equation (33). Particularly, the matrix (DED*) can be calculated, inverted and the inverted matrix can be multiplied to the right-hand side of the equation in block 163. Naturally, other methods for solving the equation in block 163 can be applied. Then, the conversion matrix G is there, and the object downmix X can be converted by multiplying the conversion matrix and the object downmix as indicated in block 164. Then, the converted downmix X' can be stereo-rendered using two stereo speakers. Depending on the implementation, certain values for μ, ν and κ can be set for calculating the conversion matrix G. Alternatively, the conversion matrix G can be calculated using all these three parameters as variables so that the parameters can be set subsequent to step 163 as desired by the user.

Preferred embodiments solve the problem of transmitting a number of individual audio objects (using a multi-channel downmix and additional control data describing the objects) and rendering the objects to a given reproduction system (loudspeaker configuration). A technique on how to modify the object related control data into control data that is compatible to the reproduction system is introduced. It further proposes suitable encoding methods based on the MPEG Surround coding scheme.

Depending on certain implementation requirements of the inventive methods, the inventive methods and signals can be implemented in hardware or in software. The implementation can be performed using a digital storage medium, in particular a disk or a CD having electronically readable control signals stored thereon, which can cooperate with a programmable computer system such that the inventive methods are performed. Generally, the present invention is, therefore, a computer program product with a program code stored on a machine-readable carrier, the program code being configured for performing at least one of the inventive methods, when the computer program products runs on a computer. In other words, the inventive methods are, therefore, a computer program having a program code for performing the inventive methods, when the computer program runs on a computer.

In other words, in accordance with an embodiment of the present case, an audio object coder for generating an encoded audio object signal using a plurality of audio objects, comprises a downmix information generator for generating downmix information indicating a distribution of the plurality of audio objects into at least two downmix channels; an object parameter generator for generating object parameters for the audio objects; and an output interface for generating the encoded audio object signal using the downmix information and the object parameters.

Optionally, the output interface may operate to generate the encoded audio signal by additionally using the plurality of downmix channels.

Further or alternatively, the parameter generator may be operative to generate the object parameters with a first time and frequency resolution, and wherein the downmix information generator is operative to generate the downmix information with a second time and frequency resolution, the second time and frequency resolution being smaller than the first time and frequency resolution.

Further, the downmix information generator may be operative to generate the downmix information such that the downmix information is equal for the whole frequency band of the audio objects.

Further, the downmix information generator may be operative to generate the downmix information such that the downmix information represents a downmix matrix defined as follows:

$$X=DS$$

wherein S is the matrix and represents the audio objects and has a number of lines being equal to the number of audio objects, wherein D is the downmix matrix, and wherein X is a matrix and represents the plurality of downmix channels and has a number of lines being equal to the number of downmix channels.

Further, the information on a portion may be a factor smaller than 1 and greater than 0.

Further, the downmixer may be operative to include the stereo representation of background music into the at least two downmix channels, and to introduce a voice track into the at least two downmix channels in a predefined ratio.

Further, the downmixer may be operative to perform a sample-wise addition of signals to be input into a downmix channel as indicated by the downmix information.

Further, the output interface may be operative to perform a data compression of the downmix information and the object parameters before generating the encoded audio object signal.

Further, the plurality of audio objects may include a stereo object represented by two audio objects having a certain non-zero correlation, and in which the downmix information generator generates a grouping information indicating the two audio objects forming the stereo object.

Further, the object parameter generator may be operative to generate object prediction parameters for the audio objects, the prediction parameters being calculated such that the weighted addition of the downmix channels for a source object controlled by the prediction parameters or the source object results in an approximation of the source object.

Further, the prediction parameters may be generated per frequency band, and wherein the audio objects cover a plurality of frequency bands.

Further, the number of audio object may be equal to N, the number of downmix channels is equal to K, and the number of object prediction parameters calculated by the object parameter generator is equal to or smaller than N·K.

Further, the object parameter generator may be operative to calculate at most K·(N−K) object prediction parameters.

Further, the object parameter generator may include an upmixer for upmixing the plurality of down-mix channels using different sets of test object prediction parameters; and in which the audio object coder furthermore comprises an iteration controller for finding the test object prediction parameters resulting in the smallest deviation between a source signal reconstructed by the upmixer and the corresponding original source signal among the different sets of test object prediction parameters.

Further, the output data synthesizer may be operative to determine the conversion matrix using the downmix information, wherein the conversion matrix is calculated so that at least portions of the downmix channels are swapped when an audio object included in a first downmix channel representing the first half of a stereo plane is to be played in the second half of the stereo plane.

Further, the audio synthesizer, may comprise a channel renderer for rendering audio output channels for the predefined audio output configuration using the spatial parameters and the at least two down-mix channels or the converted downmix channels.

Further, the output data synthesizer may be operative to output the output channels of the predefined audio output configuration additionally using the at least two downmix channels.

Further, the output data synthesizer may be operative to calculate actual downmix weights for the partial downmix matrix such that an energy of a weighted sum of two channels is equal to the energies of the channels within a limit factor.

Further, the downmix weights for the partial downmix matrix may be determined as follows:

$$w_p^2(f_{2p-1,2p-1}+f_{2p,2p}+2f_{2p-1,2p})=f_{2p-1,2p-1}+f_{2p,2p},\ p=1,2,3,$$

wherein $w_p$ is a downmix weight, p is an integer index variable, $f_{j,i}$ is a matrix element of an energy matrix representing an approximation of a covariance matrix of the output channels of the predefined output configuration.

Further, the output data synthesizer may be operative to calculate separate coefficients of the prediction matrix by solving a system of linear equations.

Further, the output data synthesizer may be operative to solve the system of linear equations based on:

$$C_3(DED^*)=A_3ED^*,$$

wherein $C_3$ is Two-To-Three prediction matrix, D is the downmix matrix derived from the downmix information, E is an energy matrix derived from the audio source objects, and $A_3$ is the reduced downmix matrix, and wherein the "*" indicates the complex conjugate operation.

Further, the prediction parameters for the Two-To-Three upmix may be derived from a parameterization of the prediction matrix so that the prediction matrix is defined by using two parameters only, and in which the output data synthesizer is operative to preprocess the at least two downmix channels so that the effect of the preprocessing and the parameterized prediction matrix corresponds to a desired upmix matrix.

Further, the parameterization of the prediction matrix may be as follows:

$$C_{TTT}=\frac{\gamma}{3}\begin{bmatrix}\alpha+2 & \beta-1\\ \alpha-1 & \beta+2\\ 1-\alpha & 1-\beta\end{bmatrix},$$

wherein the index TTT is the parameterized prediction matrix, and wherein α, β and γ are factors.

Further, a downmix conversion matrix G may be calculated as follows:

$$G=D_{TTT}C_3,$$

wherein $C_3$ is a Two-To-Three prediction matrix, wherein $D_{TTT}$ and $C_{TTT}$ is equal to I, wherein I is a two-by-two identity matrix, and wherein $C_{TTT}$ is based on:

$$C_{TTT}=\frac{\gamma}{3}\begin{bmatrix}\alpha+2 & \beta-1\\ \alpha-1 & \beta+2\\ 1-\alpha & 1-\beta\end{bmatrix},$$

wherein α, β and γ are constant factors.

Further, the prediction parameters for the Two-To-Three upmix may be determined as α and β, wherein γ is set to 1.

Further, the output data synthesizer may be operative to calculate the energy parameters for the Three-Two-Six upmix using an energy matrix F based on:

$$YY^*\approx F==AEA^*,$$

wherein A is the rendering matrix, E is the energy matrix derived from the audio source objects, Y is an output channel matrix and "*" indicates the complex conjugate operation.

Further, the output data synthesizer may be operative to calculate the energy parameters by combining elements of the energy matrix.

Further, output data synthesizer may be operative to calculate the energy parameters based on the following equations:

$$CLD_0 = 10\log_{10}\left(\frac{f_{55}}{f_{66}}\right),$$

$$CLD_1 = 10\log_{10}\left(\frac{f_{33}}{f_{44}}\right),$$

$$CLD_2 = 10\log_{10}\left(\frac{f_{11}}{f_{22}}\right),$$

$$ICC_1 = \frac{\varphi(f_{34})}{\sqrt{f_{33}f_{44}}},$$

$$ICC_2 = \frac{\varphi(f_{12})}{\sqrt{f_{11}f_{22}}},$$

where $\phi$ is an absolute value $\phi(z)=|z|$ or a real value operator $\phi(z)=\mathrm{Re}\{z\}$, wherein $CLD_0$ is a first channel level difference energy parameter, wherein $CLD_1$ is a second channel level difference energy parameter, wherein $CLD_2$ is a third channel level difference energy parameter, wherein $ICC_1$ is a first inter-channel coherence energy parameter, and $ICC_2$ is a second inter-channel coherence energy parameter, and wherein $f_{ij}$ are elements of an energy matrix F at positions i,j in this matrix.

Further, the first group of parameters may include energy parameters, and in which the output data synthesizer is operative to derive the energy parameters by combining elements of the energy matrix F.

Further, the energy parameters may be derived based on:

$$CLD^0_{TTT} = 10\log_{10}\left(\frac{\|l\|^2 + \|r\|^2}{\|c\|^2}\right) = 10\log_{10}\left(\frac{f_{11} + f_{22} + f_{33} + f_{44}}{f_{55} + f_{66}}\right),$$

$$CLD^1_{TTT} = 10\log_{10}\left(\frac{\|l\|^2}{\|r\|^2}\right) = 10\log_{10}\left(\frac{f_{11} + f_{22}}{f_{33} + f_{44}}\right),$$

wherein $CLD^0_{TTT}$ is a first energy parameter of the first group and wherein $CLD^1_{TTT}$ is a second energy parameter of the first group of parameters.

Further, the output data synthesizer may be operative to calculate weight factors for weighting the downmix channels, the weight factors being used for controlling arbitrary downmix gain factors of the spatial decoder.

Further, the output data synthesizer may be operative to calculate the weight factors based on:

$$Z = DED^*,$$

$$W = D_{26}ED^*_{26},$$

$$G = \begin{bmatrix} \sqrt{w_{11}/z_{11}} & 0 \\ 0 & \sqrt{w_{22}/z_{22}} \end{bmatrix},$$

wherein D is the downmix matrix, E is an energy matrix derived from the audio source objects, wherein W is an intermediate matrix, wherein $D_{26}$ is the partial downmix matrix for downmixing from 6 to 2 channels of the predetermined output configuration, and wherein G is the conversion matrix including the arbitrary downmix gain factors of the spatial decoder.

Further, the output data synthesizer may be operative to calculate the energy matrix based on:

$$E=CZC^*,$$

wherein E is the energy matrix, C is the prediction parameter matrix, and Z is a covariance matrix of the at least two downmix channels.

Further, the output data synthesizer may be operative to calculate the conversion matrix based on:

$$G=A_2 \cdot C,$$

wherein G is the conversion matrix, $A_2$ is the partial rendering matrix, and C is the prediction parameter matrix.

Further, the output data synthesizer may be operative to calculate the conversion matrix based on:

$$G(DED^*)=A_2ED^*,$$

wherein G is an energy matrix derived from the audio source of tracks, D is a downmix matrix derived from the downmix information, $A_2$ is a reduced rendering matrix, and "*" indicates the complete conjugate operation.

Further, the parameterized stereo rendering matrix $A_2$ may be determined as follows:

$$\begin{bmatrix} \mu & 1-\mu & \nu \\ 1-\kappa & \kappa & \nu \end{bmatrix}$$

wherein $\mu$, $\nu$, and $\kappa$ are real valued parameters to be set in accordance with position and volume of one or more source audio objects.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio object coder for generating an encoded audio object signal using a plurality of audio objects, comprising:

a downmix information generator configured for generating downmix information indicating a distribution of the plurality of audio objects into at least two downmix channels, wherein the plurality of audio objects includes a stereo object represented by two audio objects having a certain non-zero correlation;

an object parameter generator configured for generating object parameters for the plurality of audio objects and correlation data for the stereo object; and an output interface configured for generating the encoded audio object signal using the downmix information, the object parameters, and the correlation data for the stereo object.

2. The audio object coder of claim 1, further comprising:

wherein the number of audio objects is larger than the number of downmix channels, and wherein the downmixer is coupled to the downmix information generator so that the distribution of the plurality of audio objects into the plurality of downmix channels is conducted as indicated in the downmix information.

3. The audio object coder of claim 1, wherein the downmix information generator is operative to calculate the downmix information so that the downmix information indicates, which audio object is fully or partly comprised within one or more of the at least two downmix channels, and when an audio object is comprised within more than one downmix channel, an information on a portion of the plurality of audio objects comprised within one downmix channel of the more than one downmix channels.

4. The audio object coder of claim 1, in which the downmix information generator is operative to generate a power information and a correlation information indicating a power characteristic and a correlation characteristic of the at least two downmix channels.

5. An audio object coding method for generating an encoded audio object signal using a plurality of audio objects, comprising:

generating downmix information indicating a distribution of the plurality of audio objects into at least two downmix channels, wherein the plurality of audio objects includes a stereo object represented by two audio objects having a certain non-zero correlation;

generating object parameters for the plurality of audio objects and correlation data for the stereo object; and generating the encoded audio object signal using the downmix information, the object parameters, and the correlation data for the stereo object.

6. An audio synthesizer for generating output data using an encoded audio object signal, the encoded audio object signal comprising object parameters for a plurality of audio objects and correlation data for a stereo object, comprising:

an output data synthesizer configured for generating the output data usable for rendering a plurality of output channels of a predefined audio output configuration representing the plurality of audio objects, wherein the output data synthesizer is operative to receive, as an input, the obiect parameters for the plurality of audio objects and the correlation data for the stereo object, and wherein the output data synthesizer is operative to use at least two downmix channels, additional downmix information indicating a distribution of the plurality of audio objects into the at least two downmix channels, the audio object parameters for the plurality of audio objects, and the correlation data for the stereo obiect.

7. The audio synthesizer of claim 6, in which the output data synthesizer is operative to transcode the audio object parameters into spatial parameters for the predefined audio output configuration additionally using an intended positioning of the plurality of audio objects in the audio output configuration.

8. The audio synthesizer of claim 6, in which the output data synthesizer is operative to convert the plurality of downmix channels into a stereo downmix for the predefined audio output configuration using a conversion matrix derived from the intended positioning of the plurality of audio objects.

9. The audio synthesizer of claim 7, in which the spatial parameters comprise the first group of parameters for a Two-To-Three upmix and a second group of energy parameters for a Three-To-Six upmix, and in which the output data synthesizer is operative to calculate prediction parameters for a Two-To-Three prediction matrix using a rendering matrix as determined by an intended positioning of the plurality of audio objects, a partial downmix matrix describing a downmixing of the output channels to three channels generated by a hypothetical Two-To-Three upmixing process, and the downmix information.

10. The audio synthesizer of claim 9, in which the object parameters are object prediction parameters, and wherein the output data synthesizer is operative to pre-calculate an energy matrix based on the object prediction parameters, the downmix information, and energy information corresponding to the downmix channels.

11. The audio synthesizer of claim 6, in which the output data synthesizer is operative to generate two stereo channels for a stereo output configuration by calculating a parameterized stereo rendering matrix and a conversion matrix depending on the parameterized stereo rendering matrix.

12. An audio synthesizing method for generating output data using an encoded audio object signal, the encoded audio object signal comprising obiect parameters for a plurality of audio objects, and correlation data for a stereo object, comprising:

generating the output data usable for creating a plurality of output channels of a predefined audio output configuration representing the plurality of audio objects, by receiving, as an input, the obiect parameters for the plurality of audio objects and the correlation data for the stereo object, and by using at least two downmix channels, additional downmix information indicating a distribution of the plurality of audio objects into the at least two downmix channels, the audio object parameters for the plurality of audio objects, and the correlation data for the stereo object.

13. A non-transitory storage medium having stored thereon an encoded audio object signal comprising the at least two downmix channels, in addition to the at least two downmix channels, a downmix information indicating a distribution of a plurality of audio objects into at least two downmix channels, object parameters, and correlation data for a stereo object of the plurality of audio objects, the object parameters being such that the reconstruction of the plurality of audio objects is possible using the object parameters, the correlation data for the stereo object, and the at least two downmix channels.

14. A non-transitory storage medium having stored thereon a computer program for performing, when running on a computer, an audio object coding method for generating an encoded audio object signal using a plurality of audio objects, the method comprising:

generating downmix information indicating a distribution of the plurality of audio objects into the at least two downmix channels, wherein the plurality of audio objects includes a stereo obiect represented by two audio objects having a certain non-zero correlation;

generating object parameters for the plurality of audio objects and correlation data for the stereo object; and generating the encoded audio object signal using the downmix information, the object parameters, and the correlation data for the stereo object.

15. A non-transitory storage medium having stored thereon a computer program for performing, when running on a computer, an audio synthesizing method for generating output data using an encoded audio object signal, the encoded audio object signal comprising object parameters for a plurality of audio objects, and correlation data for a stereo object, the method comprising:

generating the output data usable for creating a plurality of output channels of a predefined audio output configuration representing the plurality of audio objects, by receiving, as an input, the object parameters and the correlation data for the stereo object, and by using at least two downmix channels, additional downmix information indicating a distribution of the plurality of audio objects into at least two downmix channels, the audio object parameters for the plurality of audio objects, and the correlation data for the stereo object.

* * * * *